US006731890B1

(12) United States Patent
Rakov et al.

(10) Patent No.: US 6,731,890 B1
(45) Date of Patent: May 4, 2004

(54) TRANSFER OF TONER USING A TIME-VARYING TRANSFER STATION CURRENT

(75) Inventors: David McLaughlin Rakov, Rochester, NY (US); Frank Alexander Shuster, Rochester, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/294,378

(22) Filed: Nov. 14, 2002

(51) Int. Cl.[7] ..... G03G 15/16
(52) U.S. Cl. ..... 399/66; 399/299; 399/315
(58) Field of Search ..... 399/66, 299, 310, 399/313, 314, 315; 430/126

(56) References Cited

U.S. PATENT DOCUMENTS 6,021,287 A * 2/2000 Tanaka ..... 399/66
6,564,020 B2 * 5/2003 Kuribayashi et al. ..... 399/66
2003/0035658 A1 * 2/2003 Hirokazu ..... 399/66

FOREIGN PATENT DOCUMENTS

JP 10-240023 A * 9/1998
JP 2002-323817 A * 11/2002

* cited by examiner

*Primary Examiner*—Joan Pendegrass
(74) *Attorney, Agent, or Firm*—Lawrence P. Kessler

(57) ABSTRACT

An electrostatographic machine having a transfer station including a toner image carrier and a transfer member for electrostatic transfer of toner from the toner image carrier to a toner-image area on a receiver sheet in a nip formed between the toner image carrier and the transfer member. Receiver sheet has a leading edge included in a leading edge margin area and a trailing edge included in a trailing edge margin area. A programmable power supply supplies and controls transfer station current. Before the leading edge enters the nip and after the trailing edge leaves the nip, but not while the toner-image area is in the nip, transfer station current is successively switchably altered by the programmable power supply between at least two predetermined magnitudes. The transfer station current is preferably zero, of a low magnitude, in at least a portion of the leading edge margin area so as to effectively suppress wrap.

40 Claims, 12 Drawing Sheets

TRANSFER OF TONER USING A TIME-VARYING TRANSFER STATION CURRENT

FIELD OF THE INVENTION

The invention relates to electrostatographic method and apparatus or electrostatic transfer of toner particles from a toner-image-donor roller to a receiver sheet in a transfer station, and more particularly to a time-varying transfer station current while the receiver sheet is in the transfer station.

BACKGROUND OF THE INVENTION

U.S. Pat. No. 6,184,911 includes exemplary disclosure of a modular printer in which a respective secondary transfer station, included in a respective module of a plurality of tandem imaging modules, has a current regulated power supply for providing transfer station current in the respective secondary transfer station.

The Rodenberg et al. patent (U.S. Pat. No. 5,040,029) discloses a paper receiver member inserted between a photoconductive (PC) web and a transfer drum included in a multicolor electrostatographic printer, the paper receiver to be picked up by the drum. The transfer electric field is turned off for the leading edge of the receiver to aid separation from the PC web. After the last image is transferred, the transfer field is applied to the lead edge to help attach the paper receiver member to the web.

FIG. 1A illustrates an exemplary configuration of rollers in a transfer station, designated by the numeral 100. The transfer station is for electrostatic transfer and includes a toner-image-donor roller 110 including a deformable or compliant blanket 111 around a rigid core 112. Roller 110 can be for example an intermediate transfer type of roller, a photoconductor type of roller, or an electrographic imaging type of roller. Outer layers around blanket 111 which characterize the particular type of roller 110 are not shown, e.g., for usage as an intermediate transfer roller. A receiver sheet 130 is shown being transported on a transport web 135 towards a nip 140 formed between a transfer member 120 (roller or other suitable transfer member such as an electrified ski or brush for example) and roller 110, in which nip a toner image 115 carried by toner-image-donor roller is to be transferred to receiver sheet 130. Another receiver sheet 131 including a transferred image 116 is the previous in a series of N receiver sheets moved through nip 140, with receiver sheet 130 being identified as sheet (N+1). Transfer member includes a rigid core 122 and preferably a compliant layer 121 around the core. Electrostatic transfer is accomplished by providing an electric field between rollers 110 and 120 so as to urge toner particles to move from roller 110 to 120 within nip 140.

FIG. 1B illustrates the exemplary problem of unwanted wrap. Sometimes, a receiver sheet will detach from a transport web and stick to a toner-image-donor roller as the receiver sheet comes out of a transfer nip, causing a paper jam. A wrap is exemplified in the configuration 150 showing a toner-image-donor roller 155, a transfer member 165, a transport web 170 and a receiver sheet 160 partially wrapped around roller 155. The receiver sheet 160 is electrostatically adhered or tacked down to web 170. Receiver sheet 160, prior to being tacked down to web 170, tended to curl upwards, i.e., away from the web. After being adhered as depicted in FIG. 1A, such curl is largely flattened by the electrostatic tack force, yet a propensity to curl still exists near the leading edge 161 of receiver sheet 160, where the tack force can be opposed by a relatively strong curl stress When even a small air gap forms between a receiver sheet and a transport web at the leading edge of the sheet as the sheet emerges from the transfer nip, the high electric field in the post-nip region can cause ionization of the air in this air gap. Due to the electric field, charge of one polarity will be deposited on the receiver sheet and the charge of the other polarity will be deposited on the transport web. The same electric field will cause the charge deposited on the receiver sheet to be attracted to the toner-image-donor roller, thereby attracting the receiver sheet to the intermediate roller.

In addition to curl, several other factors can contribute to producing an air gap between a receiver sheet and a transport web at the lead edge of the sheet, as the sheet emerges from the transfer nip. These other factors include paper cockle, burrs on the lead edge from cutting the sheets, receiver surface roughness, and transport web surface roughness or kinks.

A way to reduce the occurrence of wraps is to make roller 155 very small, say 50 mm diameter or less. However, this is generally disadvantageous or impractical, and a transfer member typically has a diameter of at least 150 mm so as to provide sufficient space for necessary process elements. For example, a photoconductive primary imaging roller (not illustrated in FIG. 1B) is generally used in conjunction with an intermediate transfer roller 155, with bulky process elements such as for example chargers, a toning station, a writer, and cleaners situated at various locations around the photoconductor drum and the intermediate roller, which situation demands a large diameter intermediate transfer roller.

Moreover, a typical transfer station current required for transferring a toner image to a receiver sheet is about 25 microamps, for a typical nip length (e.g., perpendicular to direction of arrow b of FIG. 1B) of about 360 mm and a transport web speed of about 300 (millimeters)($sec^{-1}$). Tests have shown that reducing transfer station current to 15 microamps or less reduces the tendency of receiver sheets to wrap on an intermediate transfer roller. However, it was found that a transfer station current this low does not produce good transfer. Therefore, simply reducing the transfer station current is not an option for avoidance of wrapping.

There remains a need to overcome the problem of unwanted wraps occurring in electrostatic transfer stations, which problem is ameliorated by the invention described below.

SUMMARY OF THE INVENTION

The invention provides apparatus and method for preventing or greatly reducing the frequency of paper jams, which can occur in a transfer station for electrostatic transfer of toner particles to a receiver sheet moving through the transfer station. As described above, such paper jams can for example result from a curl of a receiver sheet. This curl can cause a receiver sheet to wrap, thereby causing a paper jam in the transfer station.

More specifically, the invention provides an electrostatographic machine inclusive of a transfer station for electrostatic transfer of a toner image from a toner image carrier, such as a toner-image-donor roller (TIDR), to a toner-image area on a receiver sheet, the transfer station including a programmable, current regulated, power supply for purposes of producing a time variation of transfer station current for transferring the toner image. In particular, by controlling the magnitude of the transfer station current in a leading edge portion area of a receiver sheet, wrapping of receiver sheets can be reduced or eliminated.

In embodiments of an electrostatographic machine according to the invention, the receiver sheet is included in a plurality of receiver sheets successively moved through the transfer station, with toner transfer taking place in a nip formed between the TIDR and a transfer member (TR). The transfer station further includes a transport web for transporting the receiver sheet through the transfer station, the transport web being included in the nip, with the receiver sheet electrostatically adhered to the front face of the transport web, the back face of the transport web being in contact with the transfer member. The receiver sheet has a leading edge included in a leading edge margin area and a trailing edge included in a trailing edge margin area. Toner is transferred to the toner-image area hut not to a margin area. The electrostatographic machine includes a programmable power supply for supplying a transfer station current in the transfer station. During a time period between a time before the leading edge enters the nip and a time after the trailing edge leaves the nip, the transfer station current is switchably altered by the programmable power supply, by signals from a logic and control unit, between at least two predetermined magnitudes of transfer station current included in a plurality of predetermined magnitudes of transfer station current, such that at least one of the plurality of predetermined magnitudes of transfer station current causes transfer of a toner image carried on the TIDR from the TIDR to the toner-image area on the receiver sheet.

In one embodiment, the programmable power supply provides a low magnitude transfer station current, preferably zero transfer station current, prior to the time a leading edge of a receiver sheet enters the nip. At a certain time when the lead edge of the sheet is a certain distance beyond the transfer nip and the toner image area has not fully passed through the region where transfer can take place, the programmable power supply is switched so as to provide a high magnitude transfer station current suitable for transferring toner particles to the toner-image area. This suitable transfer station current magnitude is maintained until after the trailing edge is no longer in contact with the TIDR and has moved a distance past the nip, whereupon the transfer station current is switched to the low magnitude in readiness for a next receiver sheet to approach the nip.

In a preferred embodiment, the programmable power supply provides a low magnitude transfer station current, preferably zero transfer station current, prior to the time a leading edge of a receiver sheet enters the nip. At a certain time when a deformed compliant TIDR is in nip contact with the leading edge margin area but not in contact with the toner-image area, the programmable power supply is switched so as to provide a first burst of high magnitude transfer station current for a first short time interval, after which first short time interval the programmable power supply switches this high magnitude transfer station current to a suitable transfer station current for transferring toner particles to the toner-image area, which suitable transfer station current is smaller in magnitude and of the same sign as the burst of high transfer station current. This suitable transfer station current is maintained until after the trailing edge is no longer in contact with the TIDR and has moved a predetermined distance past the nip, whereupon the programmable power supply is switched so as to provide a second burst of transfer station current for a second short time interval, which second burst of transfer station current has a sign opposite to the sign of the first burst of transfer station current. At the end of the second short time interval, the transfer station current is switched to the low magnitude transfer station current in readiness for a next receiver sheet to approach the nip.

In another embodiment, a controlled time-varying reduction of transfer current magnitude within interframe time intervals between successive receiver sheets allows shorter interframe times so as to improve productivity of the electrostatographic machine. In this embodiment, the programmable power supply provides a low magnitude transfer station current, preferably zero, prior to the time a leading edge of a receiver sheet enters the nip. At a certain time when a deformed compliant TIDR is in nip contact with the leading edge margin area but not in contact with the toner-image area, the programmable power supply is switched so as to provide a suitable transfer station current magnitude for transferring toner particles to the toner-image area. This suitable transfer station current magnitude is maintained until a certain time when the TIDR is no longer in contact with the toner image area and is still in contact with the trailing edge margin area, whereupon the transfer station current is switched to the low magnitude and maintained at this low magnitude until the trailing edge has left the nip. This condition of low magnitude transfer station current is continued in readiness for a next receiver sheet to approach the nip.

In another preferred embodiment, a controlled time-varying reduction of transfer current within interframe time intervals between successive receiver sheets includes a burst of transfer station current in the interframe times so as to further improve productivity of the electrostatographic machine. In this embodiment, the programmable power supply provides a transfer station current of low magnitude, preferably zero, prior to the time a leading edge of a receiver sheet enters the nip. At a certain time when a deformed compliant TIDR is in nip contact with the leading edge margin area but not in contact with the toner-image area, the programmable power supply is switched so as to provide a first burst of transfer station current for a first short time interval, which first burst has a high magnitude. At the end of the first short time interval the programmable power supply switches the transfer station current to a suitable transfer station current for transferring toner particles to the toner-image area, which suitable transfer station current is smaller in magnitude and of the same sign as the burst of transfer station current. This suitable transfer station current is maintained until a certain time when the TIDR is no longer in contact with the toner image area and is still in contact with the trailing edge margin area, whereupon the transfer station current is switched to provide a second burst of transfer station current for a second short time interval, which second burst of transfer station current has a sign opposite to the sign of the first burst of transfer station current. At the end of the second short time interval, the transfer station current is switched to the low magnitude and maintained at the low magnitude until the trailing edge has left the nip. This condition of low magnitude transfer station current is continued in readiness for a next receiver sheet to approach the nip.

In an electrostatographic modular color printer embodiment of the invention, wherein modules are tandemly arranged for depositing single-color toner images sequentially on to a receiver sheet, each module includes a transfer station wherein the transfer station current can be switched as described above so as to reduce or eliminate paper jams in the respective transfer stations. When receiver sheets are transported through the modules without imaging, such as when clearing sheets from a machine when restarting after a paper jam, the transfer station currents provided in the modules by the respective programmable power supply outputs are preferably set to zero continuously. This produces better results than can be obtained from prior art options, which prior art options include leaving the transfer station currents at normal (continuous) operating magnitudes, setting the transfer voltages to zero, or shutting off the transfer station power supply outputs.

It should be noted that, by contrast with the Rodenberg et al. patent (U.S. Pat. No. 5,040,029), the inventors of the subject patent application have surprisingly found that turning off a transfer field at the leading edge of a paper receiver sheet helps the paper remain electrostatically adhered to a transport web, whereas Rodenberg et al. found that turning off the transfer field aided pick up of the paper from the photoconductor web by a roller.

The invention, and its objects and advantages, will become more apparent in the detailed description of the preferred embodiment presented below.

BRIEF DESCRIPTION OF THE DRAWINGS

In the detailed description of the preferred embodiments of the invention presented below, reference is made to the accompanying drawings, in some of which the relative relationships of the various components arc illustrated, it being understood that orientation of the apparatus may be modified. For clarity of understanding of the drawings, some elements may not be shown, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

The invention provides apparatus and method for preventing or greatly reducing the frequency of paper jams that can occur in a transfer station included in an electrostatographic machine, the transfer station for electrostatic transfer of toner particles from a toner-image-donor roller to a receiver sheet moving through the transfer station. As described above, such paper jams can for example result when receiver sheets for use in the transfer station have a curl. This curl can induce a receiver sheet to produce a so-called wrap when the receiver sheet becomes wrapped around the toner-image-donor roller, thereby causing a paper jam in the transfer station. Curl can be particularly deleterious when receiver sheets are made of moderate to heavy stock, such as for example a receiver sheet having a weight of say 120 grams per square meter and above. A curl can for example result when a receiver sheet, particularly a coated paper receiver sheet, is fed through heated rollers (e.g., fuser rollers). Also, curl can also form in receiver sheets cut from manufactured rolls.

In well-known prior art, electrostatic transfer is typically accomplished by the use of transfer stations in which the transfer voltage or current is maintained constant during transfer of a toner image to a receiver sheet. In the present invention, a transfer station current is not held constant, but rather is switched in novel fashion between at least two magnitudes of transfer current during passage of a receiver sheet through a transfer nip.

Figure 1A:
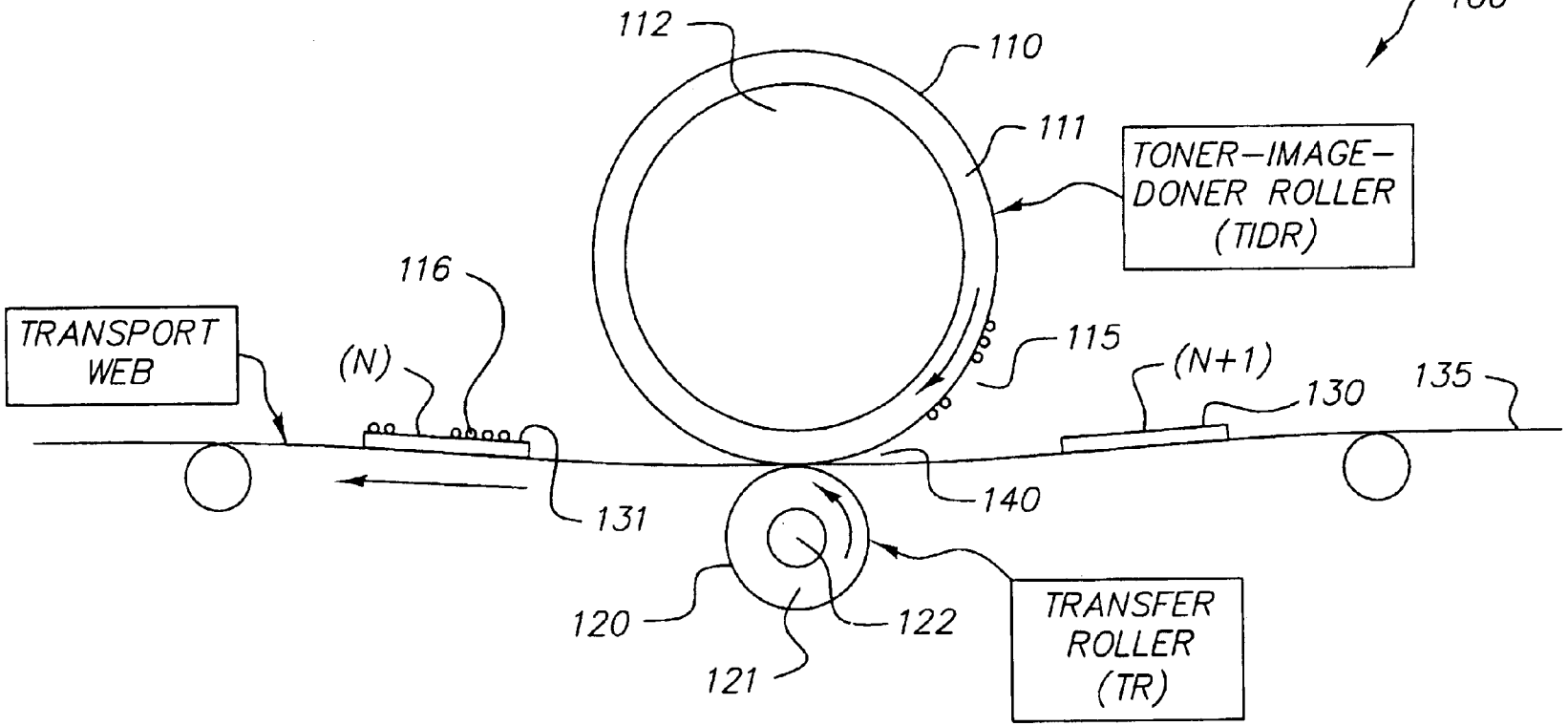
FIG. 1A illustrates certain elements included in an exemplary transfer station.
Figure 1B:
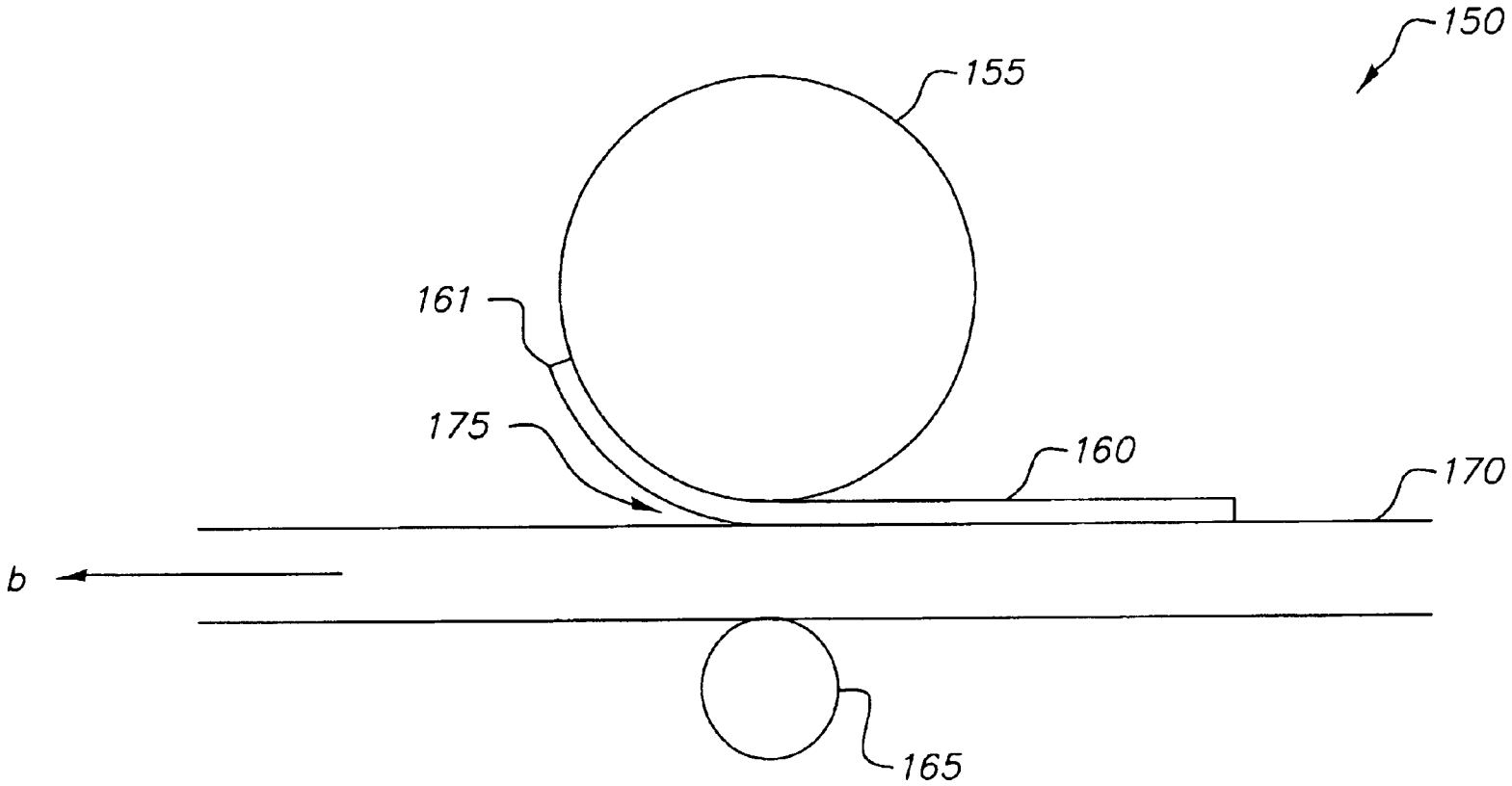
FIG. 1B illustrates an exemplary wrapping of a receiver sheet around a toner-image-donor roller.
Figure 2:
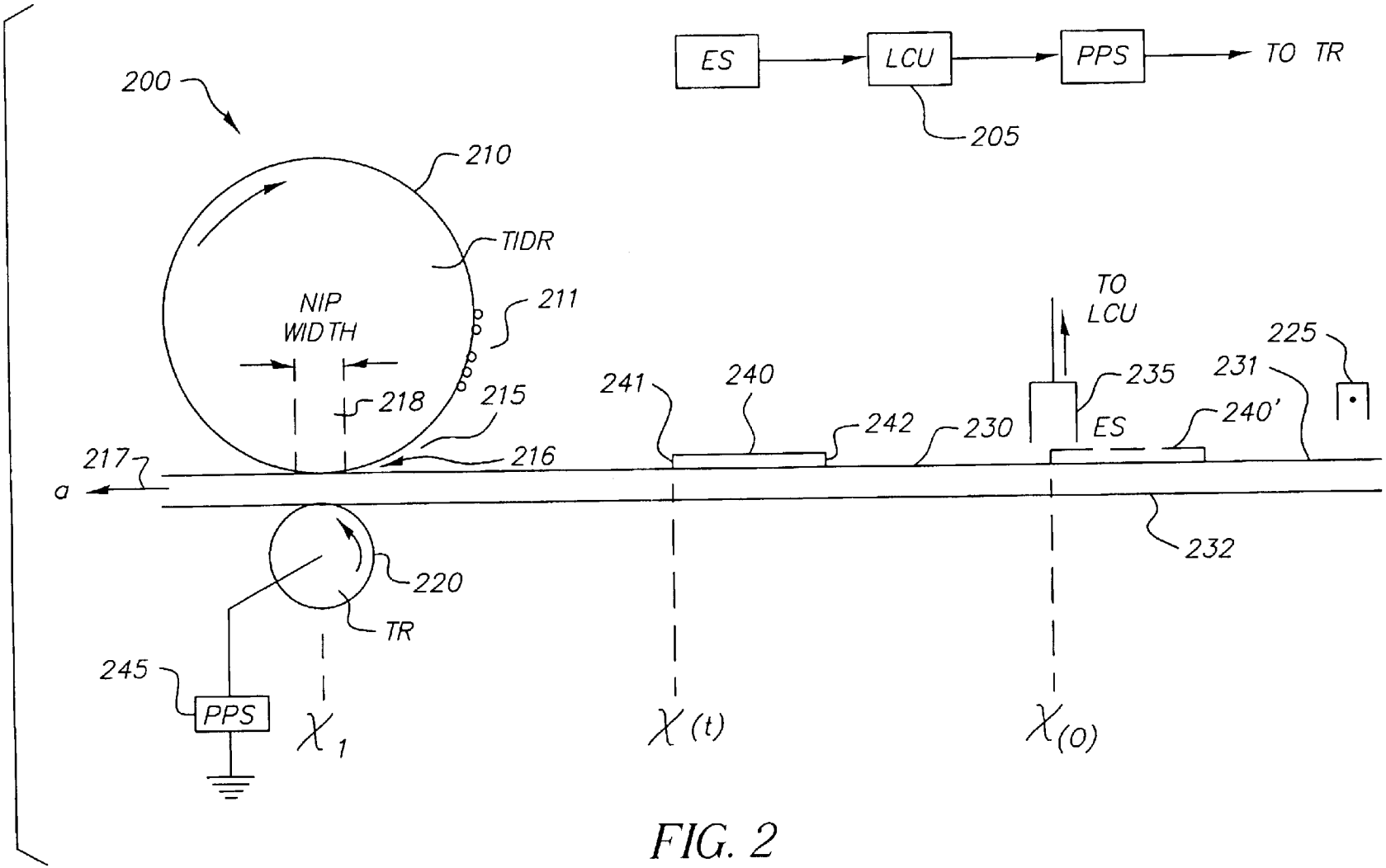
FIG. 2 illustrates a transfer station for use in the invention.

FIG. 2 illustrates a transfer station embodiment 200 for electrostatic transfer. Embodiment 200 is for inclusion in an electrostatographic machine according to the invention. A toner-image-donor roller (TIDR) 210 and a transfer member (TR) 220 form a nip 215 having an entrance 216 and an exit 217, with a transport web 230 made of insulative material driven at a known speed through nip 215 in direction of the arrow labeled, a. Nip 215 has a nip width, 218. As indicated previously in exemplary FIG. 1A, it is well known that transport web 230 may have a pre-nip and a post-nip wrap around roller 110 (pre-nip and a post-nip wraps not depicted in FIG. 2). Transport web 230 has a front face 231 and a back face 232. A receiver sheet 240 such as made of plastic or paper is electrostatically adhered to front face 231, the receiver sheet having previously been moved under a charging device, e.g., a corona charger 225, the charging device for depositing ions on sheet 240 so as to adhere the sheet to moving web 230. Web 230 is typically made of a strong material such as a polyethylene terephthalate (PET). Roller 210 is an intermediate transfer roller shown carrying a toner image 211 previously transferred in known fashion from a primary imaging member, the primary imaging member in a primary transfer nip with roller 210 (primary imaging member and primary transfer nip not illustrated). In alternative embodiments, toner-image-donor roller 210 is a compliant photoconductive imaging roller or a compliant electrographic imaging roller. An electric field between TIDR 210 and TR 220 is required to cause electrostatic transfer of toner image 211 to receiver sheet 240.

A component of the invention is a programmable power supply (PPS) indicated by the numeral 245. PPS 245 controls the electric field magnitude between TIDR 210 and TR 220. Associated with transfer of electrically charged toner particles (such as used for toner image 211) is a transfer station current provided by, and flowing through, PPS 245. Programmable power supply 245 is a current regulated supply, in which output voltage is automatically adjusted so as to produce a programmed current after any transients associated with a switching from one output current to another output current have died away. Thus for a given output current setting of the PPS 245, a transfer station current would flow not only while receivers pass through nip 215, but also when portions of the web 230 not covered by receiver sheets pass through the nip.

An important feature of the invention is to provide, via PPS 245, a time-varying transfer station current for transferring toner image 211 while receiver sheet 240 moves through nip 215. In certain embodiments, this time-varying transfer station current is altered when leading edge 241 is outside entrance 216 and/or when trailing edge 242 has departed from the exit 217. PPS 245 is programmed to provide at least two predetermined output currents for this time-varying transfer station current. For producing a preferred time-varying transfer station current, PPS 245 is switched between at least two predetermined output current settings at corresponding predetermined times. A steady output current for a certain predetermined output current setting is obtained by setting a corresponding input or control voltage in a low-voltage circuit within PPS 245, with the steady output current magnitude being proportional to the control voltage magnitude. Thus, to switch from a given predetermined output current setting to another predetermined output current setting, a control voltage is switched from one value to another. Typically, after (rapidly) switching the control voltage, a transient output current is produced which approaches a current regulated after a characteristic time interval determined by the slew rate of PPS 245. The electric field in the transfer nip typically changes more slowly, due to the time required charge or discharge the capacitance of the transfer nip and any stray capacitances.

For use in conjunction with PPS 245 is an edge sensor (ES) 235 located upstream of nip 215. The edge sensor (ES) 235 senses for example the leading edge of a receiver sheet as the receiver sheet passes by, and sends a corresponding electronic timing signal to a logic and control unit (LCU) 205 as indicated at the top of FIG. 2, wherein the timing signal information is stored. A dotted line 240' indicates a position, $x_0$, where the leading edge of any receiver sheet is sensed by ES 235. Another position, $x_1$, corresponds to the location of the center of nip 215. Thus, with the speed of web 230 constant and known, the time for any receiver sheet to travel from $x_0$ to $x_1$ is, in effect, known within a certain tolerance. If the speed of web 230 is variable from time to time, a precise speed of web 230 can for example be measured in well known fashion at a particular time by measuring a time for a fiducial mark located on for example the front face 231 to pass two fiducial-mark-sensing devices located a known distance apart (fiducial mark and fiducial-mark-sensing devices not illustrated). This precise time can for example be calculated in the LCU 205 from signals sent from the fiducial-mark-sensing devices to the LCU. Thus, with the speed of web 230 stored in LCU 205 or accurately calculated therein, the position of leading edge 241 is calculable in the LCU for any time after the leading edge has passed $x_0$. PPS 245 can be activated by LCU 205 at any predetermined time so as to cause a switching from a given predetermined control voltage to another predetermined control voltage, which predetermined time can be calculated in the LCU to correspond to any predetermined position of the leading edge 241 as receiver sheet 240 approaches and moves through nip 215. Of course, other well-known methods of accurately determining web position are suitable for use with this invention.

It has been found for a transfer station of the invention (such as for example the transfer station of embodiment 200) that reducing the transfer station current to zero or close to zero for even just a few millimeters at the leading edge of a receiver sheet can greatly reduce the tendency of sheets to wrap on an intermediate roller. It is important to reduce the transfer station current to zero or close to zero, not the transfer voltage across the transfer nip. Reduction of the transfer voltage to zero can make wraps more frequent.

Because there is normally a border or margin with no image at the leading edge of a receiver sheet (as well as the other edges), it is possible to hold the transfer station current at a low magnitude insufficient for toner transfer while a portion or all of the border area passes through the transfer nip, yet without interfering with transfer of the toner image. A transfer station current held at this low magnitude for only a few millimeters past the leading edge unexpectedly produces a large benefit. The preferred value for the low magnitude is zero. Low magnitudes greater than zero are useful but provide less benefit as the magnitude increases.

For all embodiments described fully below, the transfer station current is switched to the low value magnitude before the leading edge of a receiver sheet reaches the transfer nip and after the trailing edge of the previous sheet, if any, has passed through the transfer nip. The current must be switched low soon enough to allow the programmable power supply to respond and the electric field in the transfer nip to collapse before the receiver sheet arrives. The transfer station current is switched to a high magnitude suitable for efficient toner transfer in time to build the transfer field before the toner image arrives in the nip.

It is an important feature of the invention that, when it is desired to switch to low magnitude transfer station current, the transfer station current is set to zero (or other low value), and not specifically controlled by setting the transfer station voltage to zero. Thus, reducing the transfer station current to preferably zero prevents ionization between the transfer member and the transport web. On the other hand, if the transfer station voltage were set to zero (or some other value less than the transfer station voltage required to maintain zero transfer station current), ionization would take place that discharges the transport web, which would release the electrostatic tack force holding the receiver sheet to the web and thereby cause wrap frequency to increase.

In FIGS. 3, 4, 5, and 6, idealized time variations of transfer station current for transferring a toner image according to the invention are depicted, in which figures transfer station currents are shown as switched substantially instantaneously between different values. It is to be understood that the depictions in these figures do not reflect actual variations with time of transfer station current after switchings by the programmable power supply. In actual variations, such as described below in relation to FIGS. 9 and 10, there are always time transients associated with such switchings. It will therefore be further understood that comparatively sudden changes of the control voltage are more accurately representative of the step-like changes of current (transfer station current) depicted in FIGS. 3, 4, 5, and 6, inasmuch as post-transient steady values of transfer station current are typically directly proportional to control voltage. Moreover, it is to be understood that the signs chosen for the illustrated transfer station currents are arbitrary, being dependent on the polarity of the toner particles as well as the sign convention used for defining the directions of transfer station currents in a machine of the invention, and so forth.

Figure 3:
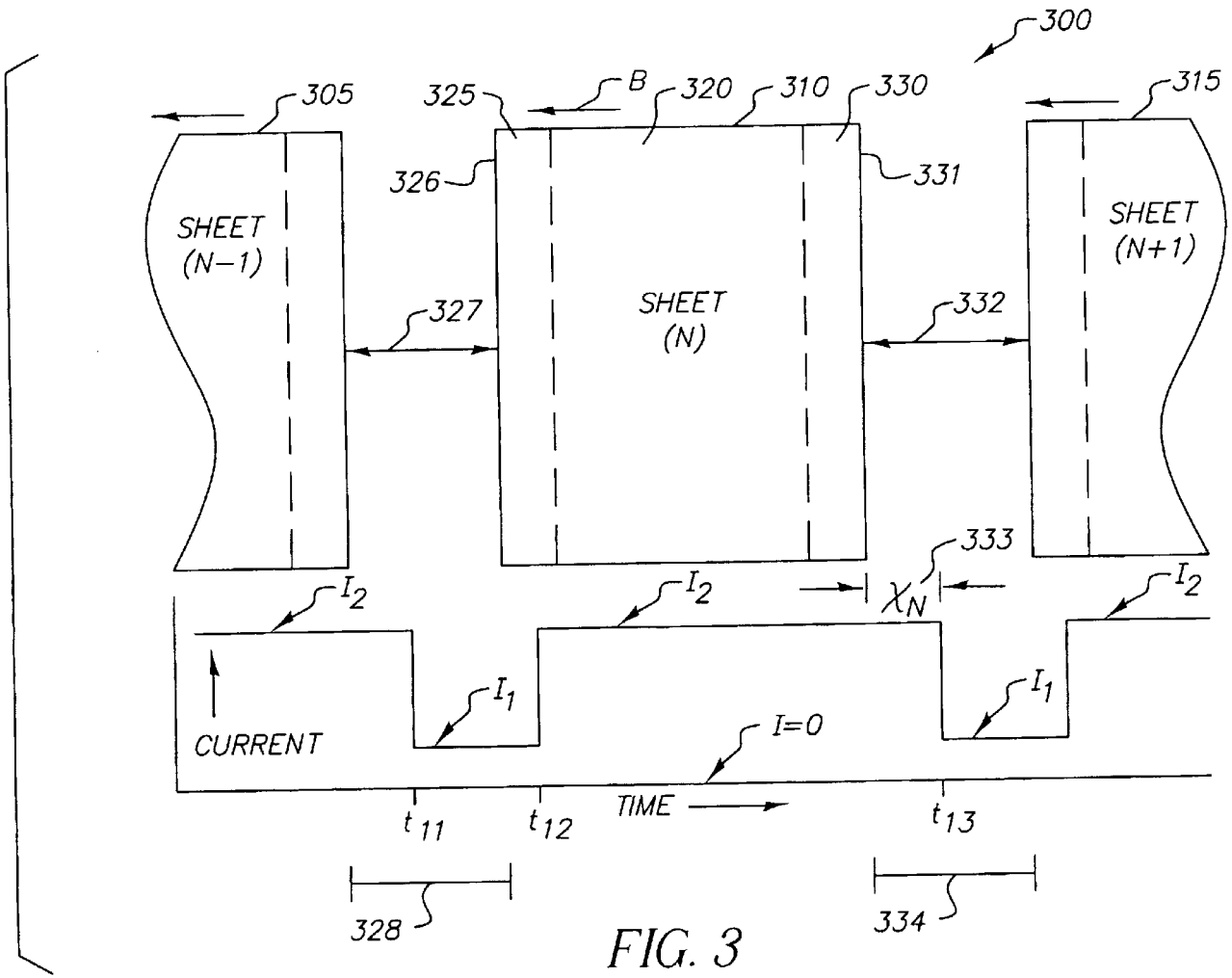
FIG. 3 depicts a scheme for providing a time variation of transfer station current for transferring a toner image during passage of a receiver sheet through a transfer station included in an embodiment of an electrostatic machine of the invention, with the graph of current versus time in the lower portion of the Fig. indicating the ideal current that is provided when the corresponding position relative to the receiver sheets shown in the upper portion of the Fig. is at the center of the transfer nip.

FIG. 3 depicts a scheme, identified by the numeral 300, for providing a time variation of transfer station current for transferring a toner image during passage of a receiver sheet through a transfer station included in an embodiment of an electrostatic machine of the invention. Scheme 300 can be used in conjunction with a transfer station similar to the transfer station 260 of FIG. 2. In scheme 300, the transfer station current for each successive receiver sheet is switched between a low magnitude $I_1$ and a high magnitude $I_2$. The resulting idealized pattern of transfer station current is shown in the lower portion of FIG. 3 for three successive receiver sheets, 305, 310, and 315, the sheets respectively labeled (N−1), (N), and (N+1). The high magnitude transfer station current $T_2$ has a nominal magnitude suitable for transferring a toner image to receiver sheet 310. Receiver sheet 310, moving in direction of arrow B and having a leading edge 326 and a trailing edge 331, is separated from the preceding sheet 305 by a leading edge interframe distance 327, which corresponds to a leading edge interframe time interval 328. Receiver sheet 310 is separated from the following sheet 315 by a trailing edge interframe distance 332, which corresponds to a trailing edge interframe time interval 334 (interframe distances enlarged for clarity). Interframe distances (times) are nominally all the same, but can differ slightly one from another due to variation in the receiver sheet feed timing, variations in sheet widths, and so forth. Receiver sheet 310 includes a toner-image area 320 into which a toner image can be transferred from a toner-image-donor roller. Receiver sheet 310 also includes margin areas into which toner is not transferred. These margin areas are identified as a leading edge margin area 325, and a trailing edge margin area 330. Each such margin area has a minimum width, which width can be quite small in an electrostatographic machine of the invention, for which a margin width can be as small as about 7 mm. A nip width of the transfer station, such as illustrated by the nip width 218 of FIG. 2, is preferably smaller than the width of each margin area, but this is not a requirement, and larger nip widths can be used to practice the invention.

In the graph of current versus time shown in the lower portion of FIG. 3, an idealized response of transfer station current (or equivalently, control voltage) to periodic switching of the control voltage according to scheme 300 is illustrated. At a time $t_{11}$ occurring when the nip width in the transfer station is preferably entirely within the leading edge interframe distance 327, the transfer station current is set to a low magnitude $I_1$ by switching the corresponding control voltage to a correspondingly low value, for which low magnitude of transfer station current toner particles are not transferable with a suitably high efficiency. Preferably, the magnitude of $I_1$ is substantially zero. At a time $t_{12}$, occurring when at least a portion and preferably all of the nip width in the transfer station is within the leading edge margin area 325 and with no portion of the toner-image-donor roller contacting the toner-image area 320, the control voltage is switched to a higher value such that, at substantially time $t_{12}$, the corresponding transfer station current $I_1$ is switched to a high magnitude, $I_2$. It is preferred that time $t_{12}$ occurs when a predetermined length of at least about 3 mm of the width of the leading edge margin area 325 of receiver sheet 310 has passed the exit to the transfer nip. With magnitude $I_2$ flowing, toner particles are transferable with a suitably high efficiency to receiver sheet 310. The value of control voltage producing transfer station current $I_2$ is maintained until a time $t_{13}$ when trailing edge 331 has moved a predetermined distance 333 ($X_N$) beyond the center of the transfer nip, with distance 333 corresponding to a predetermined portion of the trailing interface time interval 334, whereupon the control voltage is switched again so as to return, at substantially time $t_{13}$, the transfer station current to the low magnitude, $I_1$. It is preferred that $X_N$ is greater than or equal to about 3 mm. With a nip having a length (perpendicular to arrow B) equal to Y meters and the transport web moving at a process speed of S (meters)(sec$^{-1}$), a quantity equal to ($I_2$/YS) is preferably less than or equal to approximately 370 ($\mu$a)(sec)(m$^{-2}$), and more preferably, is in a range of approximately between 185 ($\mu$a)(sec)(m$^{-2}$) and 325 ($\mu$a)(sec)(m$^{-2}$).

Delays in the power supply response, or in the various circuits, could cause the current response to lag behind the control signal. In such case, the control signal could be issued earlier by a corresponding interval, so that the current switching occurs at the desired time. It could be that the control signal causing the transition from $I_1$ to $I_2$ would need to be issued before the leading edge of a sheet enters the transfer nip.

Figure 4:
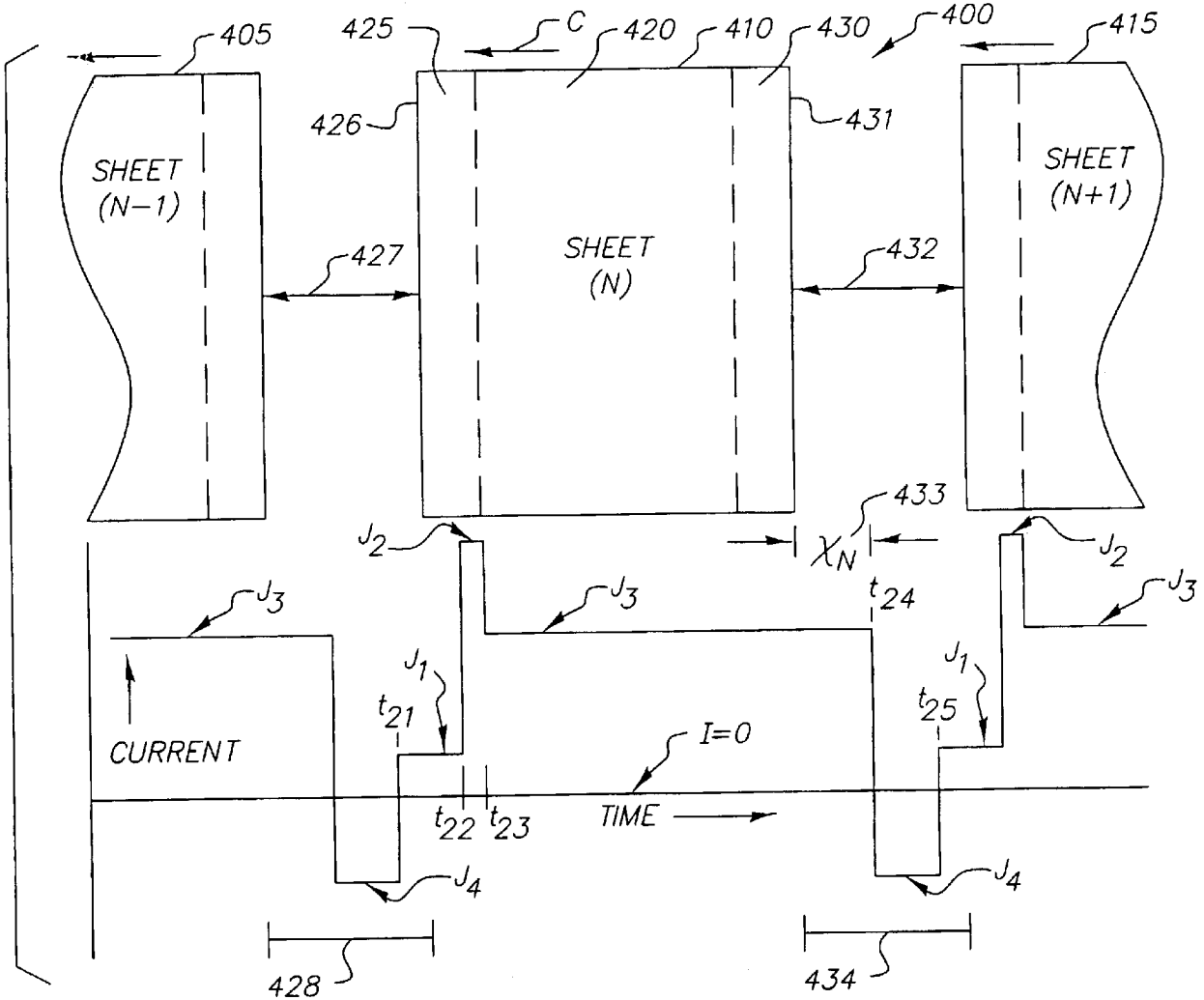
FIG. 4 depicts an alternative scheme for providing a time variation of transfer station current for transferring a toner image during passage of a receiver sheet through a transfer station included in a preferred embodiment of an electrostatic machine of the invention.

FIG. 4 depicts an alternative scheme, identified by the numeral 400, for providing a burst mode time variation of transfer station current for increasing the rate of switching the electric field in the transfer nip from a low value to a high value, and from the high value to the low value. This improvement decreases the distances that the receiver sheet moves while the electrical field in the nip is making the transitions from a low value to a high value and from a high value to a low value, thereby reducing the size of the margin needed for the wrap suppression to be effective. Alternatively, for a given small margin, increasing the rate of switching increases the effectiveness of the wrap suppression that can he achieved within the given margin. In scheme 400, numbered elements are identified by numerals between 410 and 434 inclusive, which numerals are increased by 100 for direct comparison with similar elements correspondingly identified in FIG. 3 by numerals between 310 and 334 inclusive. Receiver sheet 410 is shown moving in direction of arrow C while transfer station current is switched according to the graph in the lower portion of FIG. 4. In this graph, idealized response of transfer station current (or equivalently, control voltage) to periodic switching of the control voltage according to scheme 400 is illustrated.

At a time $t_{21}$ occurring when the nip width in the transfer station is preferably entirely within the leading edge interframe distance 427, transfer station current is set to a low magnitude $J_1$ by switching the corresponding control voltage to a correspondingly low value, for which low magnitude of transfer station current toner particles are not transferable with a suitably high efficiency. Preferably, the magnitude of $J_1$ is substantially zero. At a time $t_{22}$, occurring when at least a portion and preferably all of the nip width in the transfer station is within the leading edge margin area 425 and with no portion of the toner-image-donor roller contacting the toner-image area 420, the control voltage is switched to a higher value such that, at substantially time $t_{22}$, the corresponding transfer station current $J_1$ is switched to a high magnitude, $J_2$. It is preferred that time $t_{22}$ occurs when a predetermined length of at least about 3 mm of the width of the leading edge margin area 425 of receiver sheet 410 has passed the exit to the transfer nip. The high magnitude current, $J_2$, is a burst current. A permissible magnitude of $J_2$ requires a condition that the corresponding transfer voltage in the transfer station does not produce unwanted artifacts such as electrical discharges or breakdowns. After a short time interval during which no portion of the toner-image-donor roller contacts the toner-image area 420, the control voltage is switched to a lower value such that at substantially time $t_{23}$, the transfer station current is switched to a magnitude $J_3$. With magnitude $J_3$ flowing, toner particles are transferable with a suitably high efficiency to toner-image area 420. The magnitude of control voltage producing transfer station current $J_3$ is maintained until time $t_{24}$ when trailing edge 431 has moved a predetermined distance 433 ($X_N$), with distance 433 corresponding to a predetermined portion of the trailing edge interframe time interval 434. It is preferred that $X_N$ is greater than or equal to about 3 mm. At time $t_{24}$, the control voltage is switched to a negative burst value such that at substantially time $t_{24}$, the transfer station current is switched to a negative burst magnitude $J_4$. The negative burst magnitude $J_4$ is continued for an interval of time until time $t_{25}$, whereupon the control voltage is switched again so as to return, at substantially time $t_{25}$, the transfer station current to the low magnitude, $J_1$. With a nip having a length (perpendicular to arrow C) equal to Y meters and the transport web moving at a process speed of S (meters)(sec$^{-1}$), a quantity equal to ($J_3$/YS) is preferably less than or equal to approximately 370 ($\mu$a)(sec)(m$^{-2}$), and more preferably, is in a range of approximately between 185 ($\mu$a)(sec)(m$^{-2}$) and 325 ($\mu$a)(sec)(m$^{-2}$).

Figure 5:
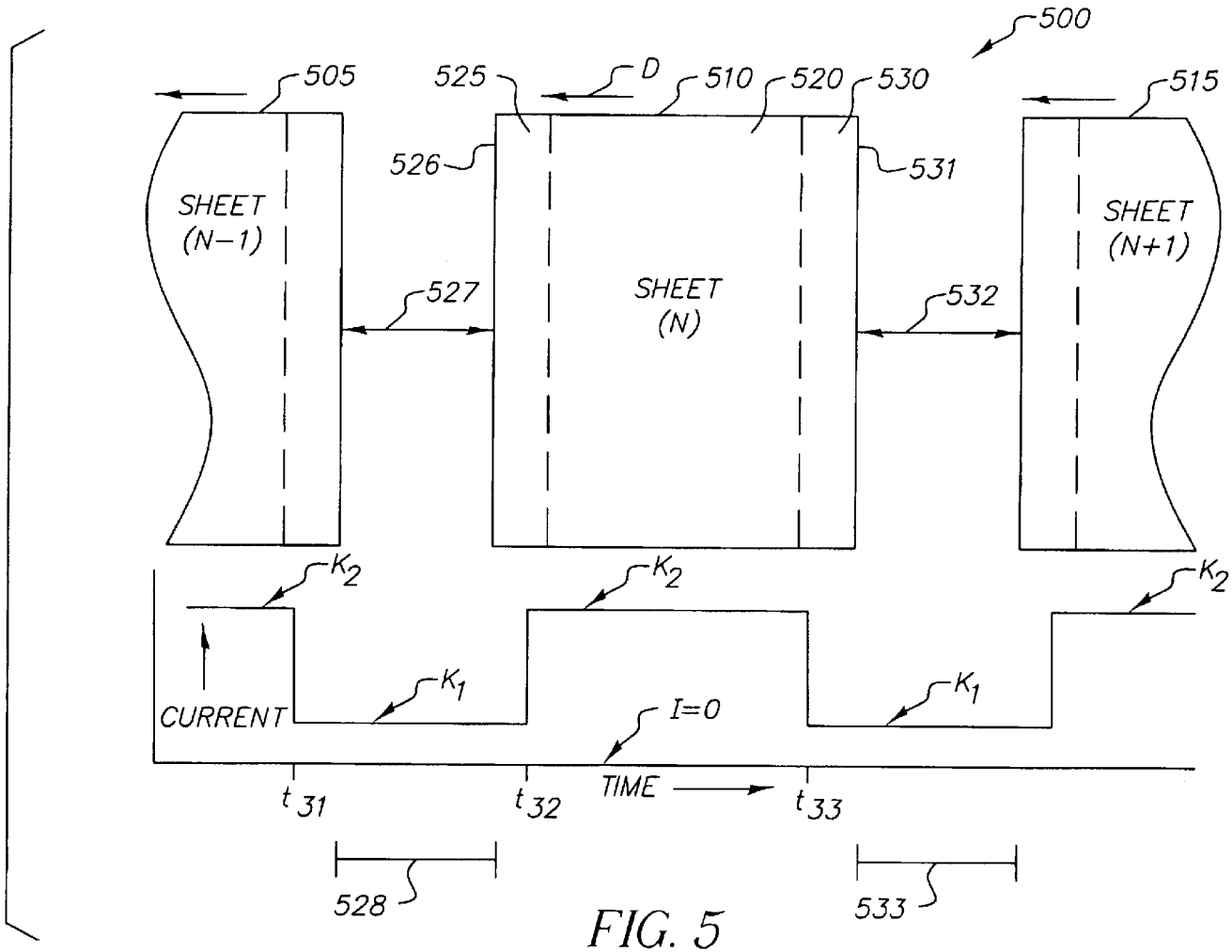
FIG. 5 depicts another alternative scheme for providing a time variation of transfer station current for transferring a toner image during passage of a receiver sheet through a transfer station included in another embodiment of an electrostatic machine of the invention.

FIG. 5 depicts another alternative scheme, identified by the numeral 500, for providing a time variation of transfer station current for transferring a toner image during passage of a receiver sheet through a transfer station included in another embodiment of an electrostatic machine of the invention. In scheme 500, numbered elements are identified by numerals between 510 and 534 inclusive, which numerals are increased by 200 for direct comparison with similar elements correspondingly identified in FIG. 3 by numerals between 310 and 334 inclusive. Receiver sheet 510 is shown moving in direction of arrow D while transfer station current is switched according to the graph in the lower portion of FIG. 5. In this graph, idealized response of transfer station current (or equivalently, control voltage) to periodic switching of the control voltage according to scheme 500 is illustrated.

At a time $t_{31}$ occurring when the nip width in the transfer station is preferably entirely within the leading edge interframe distance 527, the transfer current is set to a low magnitude $K_1$ by switching the corresponding control voltage to a correspondingly low value, for which low magnitude of transfer station current, toner particles are not transferable with a suitably high efficiency. Preferably, the magnitude of $K_1$ is substantially zero. At a time $t_{32}$, occurring when at least a portion and preferably all of the nip width in the transfer station is within the leading edge margin area 525 and with no portion of the toner-image-donor roller contacting the toner-image area 520, the control voltage is switched to a higher value such that, at substantially time $t_{32}$, the corresponding transfer station current $K_1$ is switched to a high magnitude, $K_2$. It is preferred that time $t_{32}$ occurs when a predetermined length of at least about 3 mm of the width of the leading edge margin area 525 of receiver sheet 510 has passed the exit to the transfer nip. With the transfer current of magnitude $K_2$ flowing, toner particles are transferred with a suitably high efficiency to receiver sheet 510. The value of control voltage producing transfer station current $K_2$ is maintained until a time $t_{33}$, occurring when at least a portion and preferably all of the nip width in the transfer station is within the trailing edge margin area 530 and with no portion of the toner-image-donor roller contacting the toner-image area 520. The control voltage is then switched to a lower value such that, at substantially time $t_{33}$ the transfer station current is switched back from magnitude $K_2$ to magnitude $K_1$. Current magnitude $K_1$ is then maintained until trailing edge 531 has moved past the exit of the transfer nip. With a nip having a length (perpendicular to arrow D) equal to Y meters and the transport web moving at a process speed of S (meters)(sec$^{-1}$), a quantity equal to ($K_2$/YS) is preferably less than or equal to approximately 370 ($\mu$a)(sec)(m$^{-2}$), and more preferably, is in a range of approximately between 185 ($\mu$a)(sec)(m$^{-2}$) and 325 ($\mu$a)(sec)(m$^{-2}$).

Figure 6:
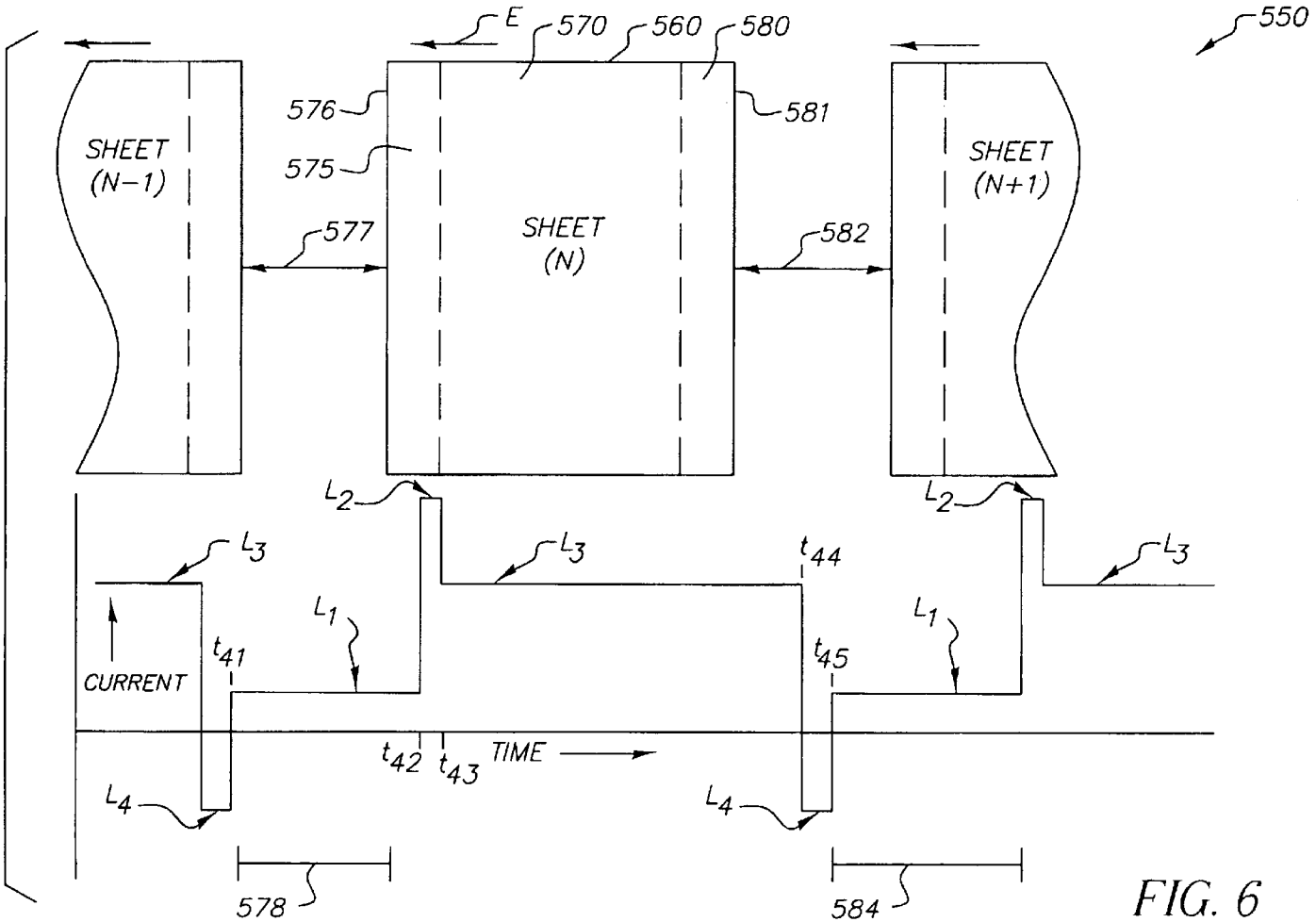
FIG. 6 depicts still another alternative scheme for providing a time variation of transfer station current for transferring a toner image during passage of a receiver sheet through a transfer station included in another preferred embodiment of an electrostatic machine of the invention.

FIG. 6 depicts another alternative scheme, identified by the numeral 550, for providing a time variation of transfer station current for transferring a toner image during passage of a receiver sheet through a transfer station included in another preferred embodiment of an electrostatic machine of the invention, the time variation including a burst mode. In scheme 550, numbered elements are identified by numerals between 560 and 584 inclusive, which numerals are increased by 250 for direct comparison with similar elements correspondingly identified in FIG. 3 by numerals between 310 and 334 inclusive. Receiver sheet 560 is shown moving in direction of arrow E while transfer station current is switched according to the graph in the lower portion of FIG. 6. In this graph, idealized response of transfer station current (or equivalently, control voltage) to periodic switching of the control voltage according to scheme 550 is illustrated.

At a time $t_{41}$ occurring when the nip width in the transfer station is preferably entirely within the leading edge interframe distance 577, is set to a low magnitude $L_1$ by switching the corresponding control voltage to a correspondingly low value, for which low magnitude of transfer station current toner particles are not transferable with a suitably high efficiency. Preferably, the magnitude of $L_1$ is substantially zero. At a time $t_{42}$, occurring when at least a portion and preferably all of the nip width in the transfer station is within the leading edge margin area 575 and with no portion of the toner-image-donor roller contacting the toner-image area 570, the control voltage is switched to a higher value such that, at substantially time $t_{42}$, the corresponding transfer station current $L_1$ is switched to a high magnitude, $L_2$. It is preferred that time $t_{42}$ occurs when a predetermined length of at least about 3 mm of the width of the leading edge margin area 575 of receiver sheet 560 has passed the exit to the transfer nip. The high magnitude current, $L_2$, is a burst current. A permissible magnitude of $L_2$ requires a condition that the corresponding transfer voltage in the transfer station does not produce unwanted artifacts such as electrical discharges or breakdowns. After a short time interval with magnitude $L_2$ flowing, during which short time interval no portion of the transfer nip overlaps the toner-image area 570 and no portion of the toner-image-donor roller contacts the toner-image area 570, the control voltage is switched to a lower value such that at substantially time $t_{43}$, the transfer station current is switched to a magnitude $L_3$. With magnitude $L_3$ flowing, toner particles are transferable with a suitably high efficiency to toner-image area 570. The value of control voltage producing transfer station current $L_3$ is maintained until a time $t_{44}$, occurring when at least a portion and preferably all of the nip width in the transfer station is within the trailing edge margin area 530 and with no portion the toner-image-donor roller contacting the toner-image area 520. The control voltage is then switched to a negative value such that, at substantially time $t_{43}$ the transfer station current is switched to a negative burst magnitude, $L_4$. Negative burst magnitude $L_4$ is then maintained for a short time interval with at least a portion of the transfer nip within trailing edge margin area 580 and during which short time interval no portion of the toner-image-donor roller contacts the toner-image area 570, whereupon the control voltage is switched again so as to return, at substantially time $t_{45}$, the transfer station current to the low magnitude, $L_1$. With a nip having a length (perpendicular to arrow E) equal to Y meters and the transport web moving at a process speed of S (meters)(sec$^{-1}$), a quantity equal to ($L_3$/YS) is preferably less than or equal to approximately 370 ($\mu$a)(sec)(m$^{-2}$), and more preferably, is in a range of approximately between 185 ($\mu$a)(sec)(m$^{-2}$) and 325 ($\mu$a)(sec)(m$^{-2}$).

Figure 7:
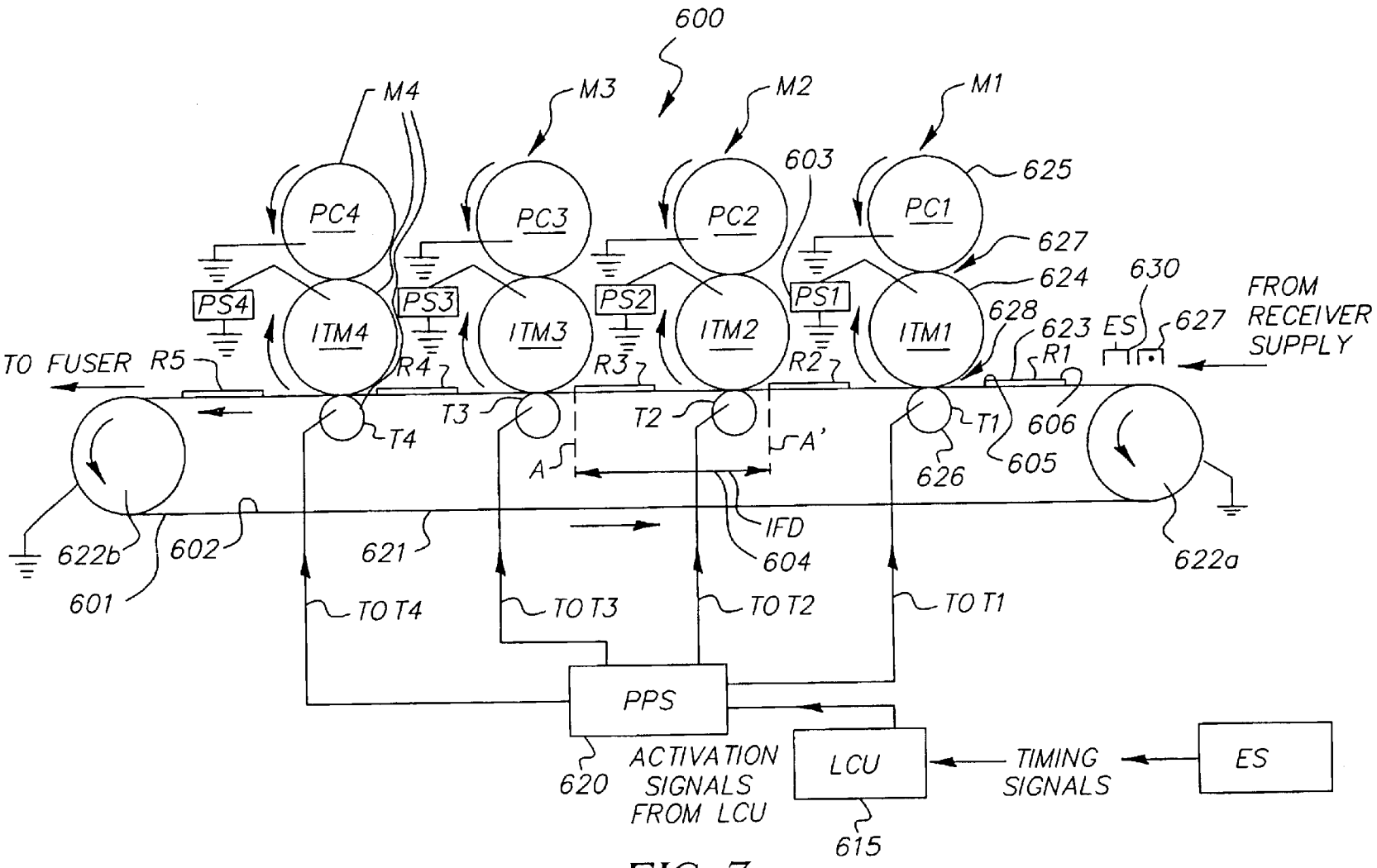
FIG. 7 depicts a modular electrostatographic machine according to the invention.

Time variation of transfer station current according to the invention can be advantageously practiced in a sequential arrangement of transfer stations included in a modular electrostatographic color printer embodiment. Thus, FIG. 7 shows, in a simplified side elevational view indicated by the numeral 600, an exemplary embodiment of an electrostatographic four-module printer of the invention (for reference see for example U.S. Pat. No. 6,184,911). Each module is capable of producing an image with a single-color toner, e.g., cyan, magenta, yellow, or black toner. More or fewer than four modules may be used. FIG. 7 shows relevant basic components. A first module indicated as M1 includes: a primary image forming member, e.g., an electrographic imaging roller or a photoconductive (PC) roller 625 labeled PC1; an intermediate transfer member (ITM) in the form of a compliant drum or roller 624 labeled ITM1; and, an electrically biased transfer member 626 labeled T1. The other modules are similarly constructed, each module including an appropriately labeled photoconductive drum, an ITM, and a transfer member, such as indicated for module M4. Each compliant intermediate transfer roller such as ITM1, ITM2, ITM3, and ITM4 is a toner-image-donor roller for carrying respective single-color toner images for transfer to receiver sheets moved through the modules. The PC rollers and/or the ITM rollers can be sleeved rollers including replaceable removable sleeve members. In printer 600, module M1 may produce for example a cyan toner image using suitable subsystems provided in the module. Thus PC drum 625 rotating counterclockwise as shown is charged, for example negatively, by a suitable charging means (not shown) and then image-wise exposed by an exposure device (not shown). The resulting electrostatic image is then developed, typically using the well-known discharged area development technique, by bringing the electrostatic latent-image bearing PC1 into proximity of an electrostatographic developer such as contained in a development station in the same module (development station not shown), the developer containing charged toner particles, e.g., negatively charged toner particles. The cyan toner image is then electrostatically transferred in a primary transfer nip labeled 627 from the PC1 to intermediate transfer member 624, with PC1 preferably grounded, and ITM1 suitably electrically biased by a power supply 603 labeled PS1 with ITM1 rotating clockwise as shown. PC1 is subsequently cleaned in a cleaning station (not shown) prior to creating another latent electrostatic image on PC1 by charging and image wise exposing. A receiver sheet 623, labeled R1 and having a leading edge 605 and a trailing edge 606, is transported from a receiver supply unit (not shown) and electrostatically adhered to the front face 601 of an endless transport web (TW) 621, e.g., by spraying ions on to R1 using a corona charger 627. TW 621 is moved to the left, e.g., by counterclockwise rotation of motor driven rollers **622*a* and 622*b*. In apparatus 600, receiver sheet 623, for example a paper or a plastic transparency sheet, moves away from charger 627 and arrives in a secondary transfer nip 628 where the cyan toner image is electrostatically transferred to R1 in a secondary transfer station, using the suitably biased transfer member 626 labeled T1. Nip 628 and the other similar nips downstream are nips. Nip 628 has a lineal pressure preferably in a range of approximately 0.7–5.6 pounds per lineal inch, with the nip 628 having a nip width in a range of approximately 2–8 mm and more preferably approximately 2–4 mm. To build up a full-color print on a receiver sheet, other single color toner images (e.g., magenta, yellow and black) are respectively sequentially transferred to the receiver sheet in otherwise similar modules M2, M3, and M4 as the receiver sheet is transported from one module to another. As a cyan image is being transferred to R1 in module M1, other color separation images may be (simultaneously) transferred to receiver sheets R2, R3 and R4 in modules M2, M3 and M4, respectively. Between successive receiver sheets is an interframe distance (IFD) such as IFD 604 located between receiver sheets R2 and R3 and delineated by the dashed lines A and A'. An unfused print, such as R5, e.g., a full-color print, is detacked in the vicinity of roller 622*b* and then transported to a fusing station (not shown) wherein the toner image is permanently fixed to the receiver sheet by heat and/or pressure. It will be understood that in certain prints, one or more of the single-color toners may not be present, the corresponding single-color toner image(s) not having been made in the respective module(s). Each of the ITM rollers is frictionally driven by contact with the moving web 621 (or by contact with receiver sheets), with the ITM frictionally driving the corresponding PC roller as indicated by the associated arrows. Additionally the transfer members T1, T2, T3, and T4 are frictionally driven by contact with the back face 602 of web 621**.

Each of the compliant intermediate transfer rollers ITM1, ITM2, ITM3, and ITM4 is preferably inclusive of a core member with an elastically deformable layer in the form of a blanket layer on the core member and a thin hard overcoat on the blanket layer (individual layers not shown). The blanket layer is resistive and preferably has a volume electrical resistivity in a range of approximately between $10^7$–$10^{11}$ ohm-cm, a thickness in a range of approximately between 5–15 mm, a Young's modulus in a range of approximately between 3.45–4.25 megapascals, and a Shore A hardness in a range of approximately between 55–65.

Each of the transfer members T1, T2, T3, and T4 is preferably inclusive of a core member with an elastically deformable resistive layer in the form of a blanket layer on the core member (individual layers not shown). Preferably, the blanket layer of the transfer member has a volume electrical resistivity in a range of approximately between $10^7$–$10^{11}$ ohm-cm, a thickness in a range of approximately between 6–8 mm, a Young's modulus in a range of approximately between 3.45–4.25 megapascals, and a Shore A hardness in a range of approximately between 55–65.

In order to effect electrostatic transfer of a toner image from for example PC1 to ITM1, a voltage of suitable polarity is provided by power supply 603 (PS1). Similarly, to effect secondary transfer of the toner image from roller 624 (ITM1) to receiver sheet 623 (R1), a suitable potential difference is established between roller 624 (ITM1) and transfer member 626 (T1). Thus a potential difference is established between the power supply 603 (PS1) and a programmable power supply 620 labeled PPS, which power supply 620 is a current regulated type of power supply. Thus, PPS 620 adjusts the potential difference for secondary transfer in such manner as to maintain any preselected transfer station current between ITM1 and T1, and similarly for the other secondary transfer stations downstream in which single-color toner images are transferred to a given receiver sheet. According to the present invention, a preselected transfer station current for transferring a toner image has a predetermined variation with time, such as described in reference to FIG. 3 or FIG. 4. For a time variation of transfer station current shown for example in FIG. 3, the transfer station current $I_3$ is maintained for a significant distance in trailing edge interframe distance 332 so as to be able to transfer, from time to time in well known fashion, control patches of toner to the front face of the transport web, e.g., to front face 601 of web 621. This requires interframe distances such as IFD 604 to be quite large, typically larger than 40 mm. A similar restriction applies for transfer station current $J_3$ of FIG. 4. On the other hand, in an alternative embodiment to printer 600 (not illustrated) a time variation of transfer station current as exemplified in FIG. 5 or FIG. 6 is advantageously used, such as for example if interframe control patches of toner are not used in interframe areas. In this alternative embodiment, it is preferred that the interframe distances between receiver sheets are advantageously shorter than in embodiment 600, thereby improving productivity of the printer.

Power supply PPS 620 controls four separately controllable outputs, i.e., controls the time varying transfer station currents flowing from the transfer members T1, T2, T3, and T4, respectively. In conjunction with the provision of these time varying transfer station currents, an edge sensor 630 labeled ES is situated upstream of the first module M1. Edge sensor ES 630 is located a known distance from the entrance to nip 628, from the exit from nip 628, and also a known distance from the center of nip 628 because the nip width of nip 628 is also known. Similarly, the distances between ES 630 and the known distances from the entrances, centers, and exits of the other secondary transfer nips downstream of nip 628 are known. Since the transport or process speed of web 621 is known a priori, a location of any leading edge can be known as function of time, the time measured from the time this leading edge is detected by ES 630. As a result, and because the length of a receiver sheet in a direction parallel to the direction of motion of the receiver is known, specific times at which the leading edge and trailing edge of a receiver sheet (e.g., leading edge 605 and trailing edge 606) reach any destination downstream from ES 630 can be known. Thus electronic timing signals corresponding to specific times that successive leading edges are detected by ES 630 are sent from ES 630 to a logic and control unit (LCU) designated by the numeral 615, in which LCU the position of a leading edge is calculated as a function of time and stored. At appropriate times, such as required by a certain specific predetermined variation with time of a respective transfer station current while a receiver sheet moves through the respective transfer station, activation signals from LCU 615 are sent to PPS 620 so as to appropriately switch the respective transfer station current from a certain transfer station current to another transfer station current. In such manner, transfer station current is switched appropriately at predetermined times for transfer of each single-color toner image required on the receiver sheet as the receiver sheet moves through the successive nips located downstream of ES 630.

An advantageous alternative for determining the timing of the activation signals uses an encoder that measures movement of the transport web, rather than a clock measuring time. The web moves a certain, known distance for each encoder pulse. The ES 630 triggers a counter to start counting encoder pulses when the lead edge of a receiver sheet reaches the sensor. After the proper number of encoder pulses, for each imaging module, a start of frame (SOF) signal is generated to trigger writing the image on the imaging roller. The number of encoder pulses between the signal from the ES 630 and the SOF signal is controlled by the LCU to register the image properly on the sheet of paper. Other counters are used in cascade, starting from the SOF signal to generate the trigger signals for switching the transfer current at the desired positions relative to the lead edge of each sheet. Using an encoder rather than a clock reduces or eliminates errors due to any change or uncertainty in the speed of the web.

In particular, a control voltage for switching a respective transfer station current from a low interframe magnitude to a high magnitude is preferably switched when at least a portion of the respective nip width is within the leading edge margin width of a receiver sheet, and with no portion of the toner-image area in contact with the respective TIDR. Furthermore, in embodiment 600, a high magnitude transfer station current is always made to flow while a respective nip width is entirely within a toner-image area of a receiver sheet. Moreover, for any time variation of transfer station current according to the invention, including the time variations of transfer station current of schemes 300, 400, 500 and 550 of FIGS. 3, 4, 5, and 6, respectively, it is preferred that the leading edges of receiver sheets move at least about 3 mm past the respective nip exits before the a respective input control voltage switches the transfer station current from the low interframe magnitude to a high magnitude.

When a receiver sheet passes through a module in which no single-color image is transferred, e.g., when the corresponding output image on the fused receiver sheet does not include the single-color corresponding to the respective module, a time-varying transfer station current according to the invention may not, and is preferably not, used. Instead, the programmable power supply can provide a different dependence of transfer station current with time as the receiver sheet passes through the respective transfer nip, such as for example a constant low magnitude transfer station current throughout. This constant low magnitude transfer station current is preferably of a magnitude of substantially zero.

In a purge mode when receiver sheets are transported through the modules without imaging, such as when clearing sheets from the machine when restarting after a paper jam, the transfer station currents provided in the modules by the respective programmable power supply outputs are set to a predetermined low magnitude continuously, which predetermined low magnitude in the purge mode is preferably substantially zero. This produces better results than can be obtained from the prior art options of leaving the transfer station currents at normal (continuous) operating values, setting the transfer voltages to zero, or shutting off the transfer station power supply outputs.

The Examples below are illustrative of the invention. In these Examples, a simplified transfer station configuration similar in most respects to that of configuration 100 of FIG. 1A was employed. In this simplified transfer station, no primary imaging roller was employed, and a toner-free intermediate transfer roller was used in lieu of toner-image-donor roller 110. Thus no toner images such as toner image 115 could be transferred during test measurements, which test measurements were carried out with the following hardware configuration:

Intermediate Transfer Roller
(corresponding for example to roller 110 of embodiment 100):

| | |
|---|---|
| Outside diameter: | 174 mm |
| Blanket thickness: | 10 mm (corresponding for example to blanket 111) |
| Blanket length: | 360 mm |
| Blanket durometer: | 60 ± 5 Shore A |
| Blanket electrical resistivity: | $5 \times 10^8$ ohm-cm |

Transport Web
(corresponding for example to web 135 of embodiment 100):

| | |
|---|---|
| Web material: | Poly(ethylene terephthalate) |
| Web thickness: | 0.100 ± 0.010 mm |
| Web transport speed: | 300 mm/second |

Transfer Member
(corresponding for example to roller 120 of embodiment 100):

| | |
|---|---|
| Transfer member outside diameter: | 44 mm |
| Transfer member blanket thickness: | 6 mm (corresponding to blanket 121) |
| Transfer member blanket length: | 360 mm |
| Transfer member blanket durometer: | 60 ± 5 Shore A |
| Transfer member blanket electrical resistivity: | $1 \times 10^9$ ohm-cm |

Nip Width:
3 mm (as per the geometry of nip width 218 of embodiment 200)

EXAMPLE 1

Wrap Suppression

Example 1 demonstrates beneficial results for paper jam avoidance using a time variation of transfer station current related to that embodied in scheme 300 of FIG. 3. The transfer station current is switched from a low magnitude $I_1$ to a high magnitude $I_2$ during the time that a receiver sheet approaches and moves through the transfer nip. In this example, $I_1$ is substantially zero in a certain time interval before being switched to $I_2$, with $I_2$ continuing to flow for some time after the trailing edge leaves the transfer nip. Example 1 demonstrates that by switching $I_2$ on when the transfer nip is inside the width of the leading edge margin area, a complete suppression of wraps of receiver sheets around the intermediate transfer roller (ITR) can result, the receiver sheets adversely having a curl prior to their use in the transfer station.

The programmable power supply used for providing electrical bias to the transfer member was a current regulated power supply. This programmable power supply can provide an output current magnitude between 0 and +40 microamps. The output transfer station current level is controlled by an input control voltage and can be switched rapidly.

The following test results demonstrate the benefit of the switching strategy. The test was run with paper receiver sheets each of which had previously been passed through a set of heated rollers so as to produce a controlled amount of curl. The amount of curl is defined as the reciprocal of the radius of curvature in meters. Curl was measure by hanging the curled sheet with the curl axis vertical and comparing the curvature of the sheet with templates cut with various radii. The paper was Ikono Silk (170 gram per square meter), manufactured by Zanders Feinpapiere AG, which when curled to produce a curl of about 11.1 $m^{-1}$ (curl radius of about 90 mm) tended to wrap frequently on the intermediate transfer roller when operating in current regulated mode without using the switching feature according to the invention. When electrostatically tacked down to the transport web with the curl concave up, the sheets wrapped about 80% of the time without the switching feature. The graph of FIG. 8 shows the results of the test using the switching feature, where the switching from zero magnitude $I_1$ to a high magnitude $I_2$ was carried out as a function of position relative to the leading edges of receiver sheets as they were moved through the transport station, with the receiver sheets electrostatically tacked to the transport web, as described above in relation to FIGS. 2 and 7.

The value on the X-axis indicates the position of the leading edge of a receiver sheet, relative to the center of the transfer nip, at a respective turn-on time when the input control signal was switched to activate the programmable power supply initiating the transition from low to high current. The high magnitude of transfer station current ($I_2$) was 25 microamps. A negative value on the abscissa indicates switching before the leading edge arrived at the middle of the nip width. A positive value indicates switching after the leading edge arrived at the middle of the nip width. The value on the ordinate indicates the frequency of wraps observed, the frequency expressed as a percentage. Each data point represents the frequency of wraps in a run of ten sheets of paper.

Figure 8:
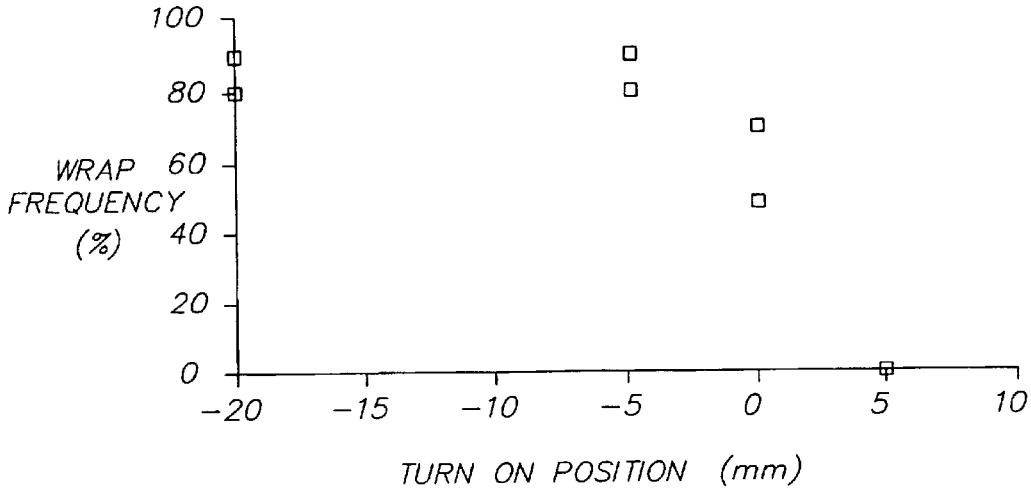
FIG. 8 is a graph illustrating how undesirable paper jams in a transfer station of the invention can be eliminated by use of a suitable variation of station transfer station current during passage of a receiver sheet through the transfer station.

The results plotted in FIG. 8 indicate some benefit was observed when the switching was initiated when the lead edge of each sheet was at the center of the transfer nip (turn on position of 0 mm). A dramatic reduction of wrap frequency occurred between 0 and +5 mm. No wraps were observed when the current was switched at +5 mm.

EXAMPLE 2

Direct Comparison of Non-Burst and Burst Current Modes

Example 2 demonstrates how burst transfer station currents employed in a mode similar that embodied in scheme 400 of FIG. 4 can significantly lower the characteristic transient times in which the transfer field responds to a sudden switching of the control voltage. Specifically, the effect of a non-burst mode similar to that embodied in scheme 300 of FIG. 3 is directly compared to the burst mode similar that embodied in scheme 400. To make this comparison, a transfer station including transport web, ITR, and TR was used. No receiver sheets were passed through the nip during the measurements.

When switching transfer station current from one magnitude to another, the electric field in the transfer nip takes some time to respond fully, because the capacitance of the nip needs to be discharged or charged accordingly while a transient transfer station current is also flowing through the resistances of the transfer member and intermediate transfer roller (or in general, the toner-image-donor roller). This process can be speeded up by utilizing a burst mode current pattern. Use of the burst mode is important for minimizing the size of the blank margin needed at the lead edge of a sheet for the field to build up to the full value needed for good transfer. It is also important for minimizing the size of the interframe needed to allow the electric field to fall to a sufficiently low value before the next sheet arrives.

A suitable transfer station current for transferring toner images is chosen to provide the maximum transfer field that does not cause artifacts due to air breakdown during transfer. The larger the value of burst transfer station current that can be provided, the faster the rise (or fall) of the transfer field. The largest practical magnitude of burst transfer station current is limited by the output capability of the programmable power supply, both the current and the voltage. The voltage comes into play because it is advantageous to use transfer members and intermediate transfer rollers that have considerable resistance, with resulting voltage drops across these resistances.

The graphs shown in FIGS. 9 and 10 demonstrate the benefit of enhanced or burst mode switching as compared with unenhanced, non-burst switching. These graphs show the results of switching using the hardware configuration described for Examples 1 and 2. For Example 2, data are plotted as a function of distance in millimeters along the web, with a first switching of control voltage initiated at an arbitrary reference position on the web, i.e., zero mm (corresponding to an arbitrary reference time). In FIGS. 9A, 9B, 9C, and 9D, experimental data are displayed for non-burst mode switching of the input control voltage (control signal) so as to initiate or turn on a transfer station current suitable for transferring a toner image in the transfer station, while in FIGS. 9E, 9F, 9G, and 9H, corresponding data are shown for the burst mode during turn on. In FIGS. 10A, 10B, 10C, and 10D, experimental data are displayed for non-burst mode switching off of the input control voltage (control signal) so as to initiate turn off of transfer station current in the transfer station, while in FIGS. 9E, 9F, 9G, and 9H, corresponding data are shown for the burst mode during turn off.

Figure 9A:
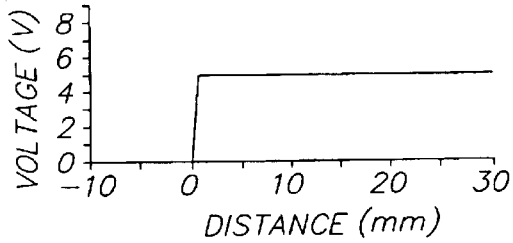
FIGS. 9A; 9B, 9C, and 9D show certain experimental data exemplifying effects of time variations of transfer station current according to an embodiment of the invention.
Figure 9B:
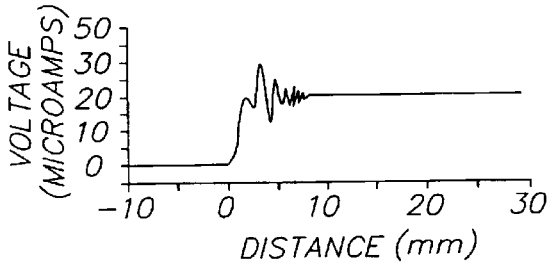
FIGS. 9E, 9F, 9G, and 9H show certain experimental data exemplifying effects of time variations of transfer station current according to another embodiment of the invention.
Figure 9C:
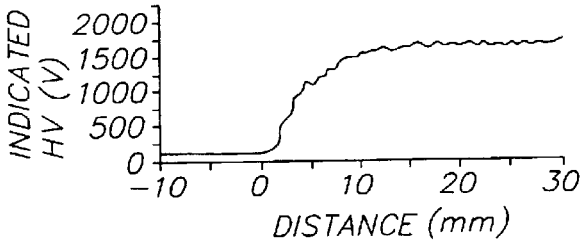
Figure 9D:
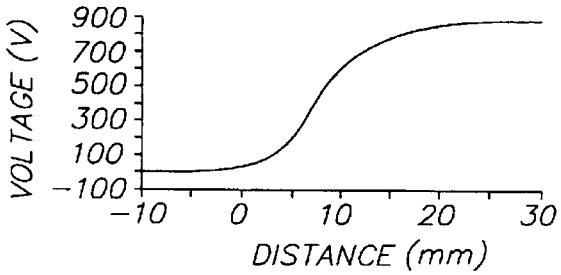
Figure 9E:
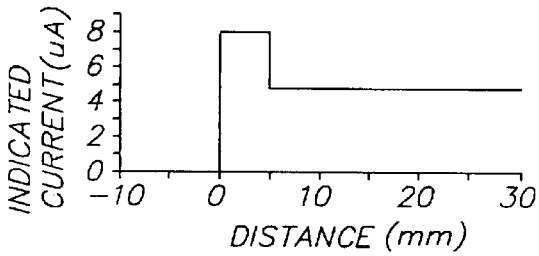
Figure 9F:
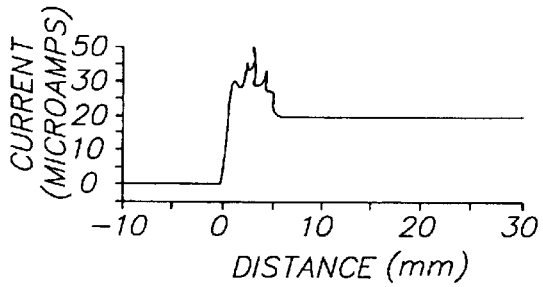
Figure 9G:
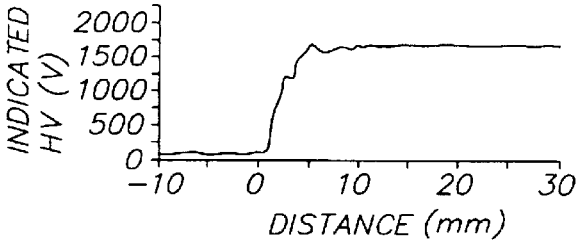
Figure 9H:
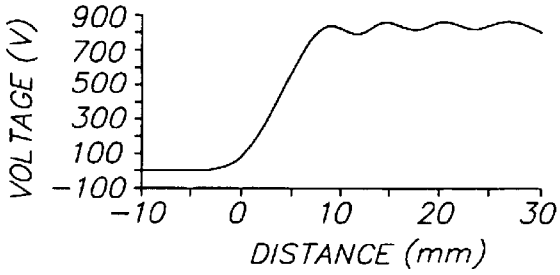
Figure 10A:
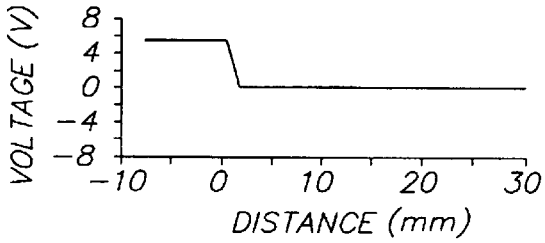
FIGS. 10A, 10B, 10C, and 10D show additional experimental data for the embodiment relating to FIGS. 9A, 9B, 9C and 9D.
Figure 10B:
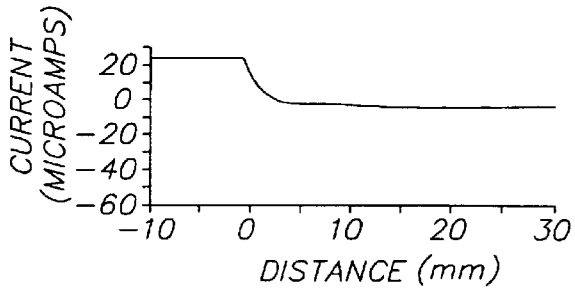
Figure 10C:
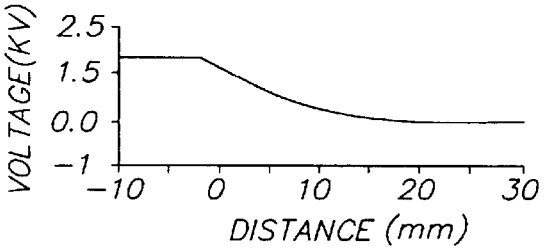
Figure 10D:
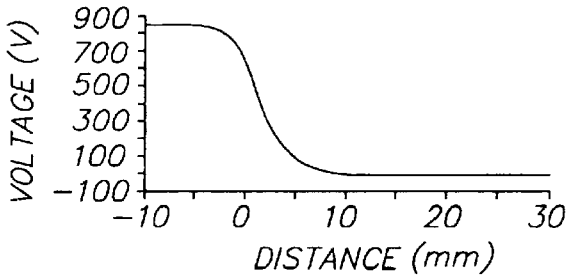
Figure 10E:
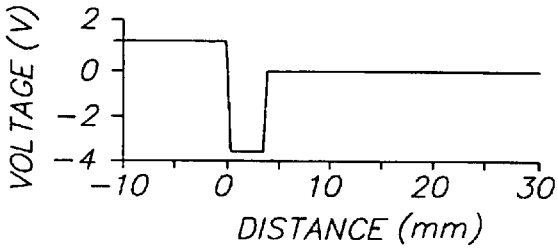
FIGS. 10E, 10F, 10G, and 10H show additional experimental data for the other embodiment relating to FIGS. 9E, 9F, 9G, and 9H.
Figure 10F:
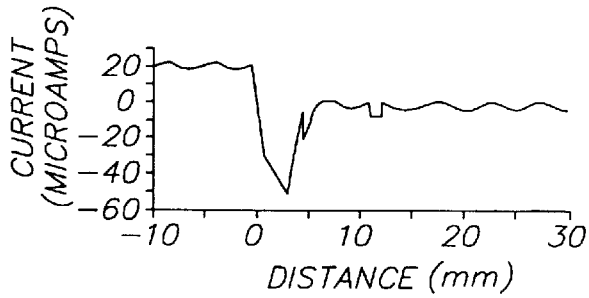
Figure 10G:
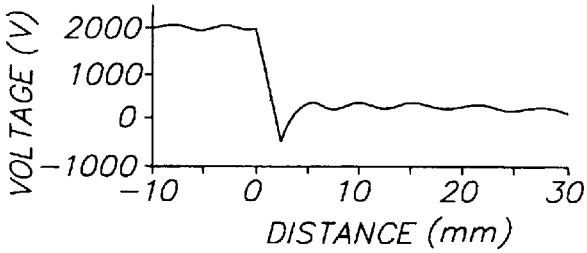
Figure 10H:
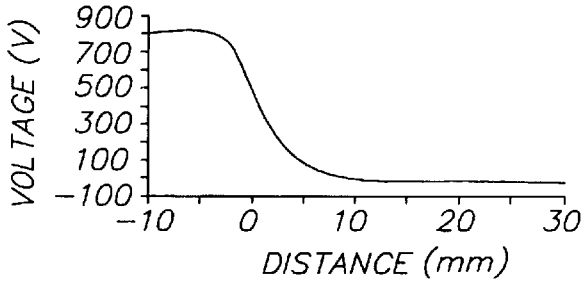

FIGS. 9A and 9E show the respective control signals for activating the current regulated power supply for turn on. FIGS. 9B and 9F indicate the respective transfer station currents measured passing through the intermediate transfer roller. FIGS. 9C and 9G show the high voltage output of the programmable power supply measured at the HV output test point. FIGS. 9D and 9H show results of measuring the voltage on the back face (see FIG. 2) of the transport web resulting from the ionization produced by the transfer member. The pattern of voltage from ionization is an indication of the transfer field. The back face voltage was measured in known way by placing a grounded electrode in contact with the front face of the transport web and monitoring the voltage on the back face by a probe connected to a non-contacting electrostatic voltmeter (e.g. Trek Model 344, from Trek Incorporated of New York) as the web moved past the probe.

Looking first at the non-hurst or unenhanced data of FIGS. 9A through 9D, it is clear that the power supply voltage and the web voltage do not rise as fast as the IT current. This is due to the time necessary to charge the capacitance of the nip (and any stray capacitances) as explained above. The benefit of the enhanced or burst mode current pulse shape of FIG. 9E can be readily seen in FIGS. 9F, 9G, and 9H, where the slopes of the transitions are much greater, resulting in the transitions taking place in smaller distances.

A similar advantage of using a burst mode in turn off is found when the control voltage is switched to zero in the non-burst mode, or some other value of opposite sign in the turn off burst mode, as illustrated in FIGS. 10A, 10B, 10C, 10D, 10E, 10F, and 10G. It takes time for the capacitance of the transfer nip to discharge, so the response of the electric field in the transfer nip lags the current signal. The response can be improved by providing a negative current burst at the time of switching, exemplified by the control voltage signal of FIG. 10E.

In general, the improvements using the burst modes can be characterized by relationships linking the burst transfer station current, such as for example the predetermined transfer station current $J_2$ of scheme 400 illustrated in FIG. 4, and the smaller transfer station current $J_3$ immediately following the burst, where this smaller transfer station current is suitable for efficient transfer of a toner image to a toner-image area on a receiver sheet. The predetermined transfer station current $J_3$ produces a transfer voltage between the toner-image-donor roller and the transfer member, with this transfer voltage being associated with a transfer capacitance as described above. For a condition of switching the transfer station current from the low magnitude $J_1$ to the burst magnitude $J_2$ (with magnitude of $J_2$ greater than magnitude of $J_3$ as depicted in FIG. 4) the transfer voltage substantially reaches a preferred magnitude when after a time interval approximately equal to $(t_{23}-t_{22})$, the transfer capacitance is preferably effectively charged by the transfer station current $J_2$. For a non-burst mode condition of switching the transfer station current from $J_1$ to $J_2$ (i.e., with the magnitude of $J_2$ equal to the magnitude of $J_3$ and equal to the magnitude of $I_2$ as depicted in scheme 300 of FIG. 3) the transfer voltage substantially reaches the preferred magnitude when the transfer capacitance is effectively charged by the transfer station current $J_3$ (equal to 12) after a corresponding time interval $\tau$ this corresponding time interval $\tau$ being independently measurable. An approximate relationship preferably connects the magnitudes of $J_2$ and $J_3$ in the burst mode of FIG. 4, given by the approximate equality: $(J_2)(t_{23}-t_{22})\approx(J_3)(\tau)$. This relation is relevant for turn-on as depicted in FIG. 9. Here the control signal voltage of FIG. 9E has a burst value of about 8 volts (corresponding to, and proportional to, $J_2$), and a steady transfer value of about 5 volts (corresponding to, and proportional to, $J_3$). The steady transfer value equals the steady value of about 5 volts in FIG. 9A. Voltage response times in FIGS. 9C, 9D, 9G, 9H (corresponding roughly to $(t_{23}-t_{22})$ and $\tau$ are approximately inversely related to the respective control voltages).

Similarly for the leading edge burst mode depicted in FIG. 6, the following approximate relationship preferably connects the magnitudes of $L_2$ and $L_3$: $(L_2)(t_{43}-t_{42})\approx(L_3)(\tau)$, which may be seen to roughly correspond with the data shown for turn off in FIG. 10. Also, at turn off, the time required to switch the transfer field from the value suitable for transfer to the chosen, lower value is inversely proportional to the current applied.

The invention is shown to have the following advantages over prior art. Paper jams can be avoided in spite of using large diameter intermediate transfer and photoconductor rollers by employing a switchably varied transfer station current for the leading edges of receiver sheets. The use of such a switchably varied transfer station current, especially with the described burst mode, can allow use of narrow leading and trailing edge margins, thereby increasing the available size of toner-image areas on receiver sheets. Moreover, machine productivity can be increased with a switchably varied transfer station current strategy for the trailing edges of receiver sheets, thereby allowing smaller interframe distances. Finally, setting the transfer station current to a low magnitude, preferably zero, continuously is an advantage when clearing paper jams in purge mode, because the positions of receiver sheets are not accurately known.

The invention has been described in detail with particular reference to certain preferred embodiments thereof, but it will be understood that variations and modifications can be effected within the spirit and scope of the invention.

What is claimed is:

1. An electrostatographic machine including at least two imaging modules having at least two respective transfer stations, said electrostatographic machine comprising:

a transfer member, for said at least two transfer stations, for electrostatically transferring a toner image from a toner image carrier to a toner-image area on a receiver sheet moved through said at least two transfer stations, an insulative material transport web for transporting a receiver sheet through said at least two transfer stations, said transport web moving at a speed equal to a process speed, said transport web having a front face and a back face, said receiver sheet being adhered to said front face, said back face in contact with said transfer member, said electrostatic transfer taking place in a nip between said toner image carrier and said transfer member, said receiver sheet having a leading edge and a trailing edge during passage of said receiver sheet adhering to said transport web through said nip, said nip having an entrance and an exit, said exit separated from said entrance by a nip width, said at least two transfer stations for applying an electric field across said nip so as to urge toner particles included in said toner image to transfer from said toner image carrier to said receiver sheet, said receiver sheet including margin areas wherein said toner image is not transferred, said margin areas including a leading edge margin area and a trailing edge margin area, said electrostatographic machine further including a programmable power supply for supplying current to said at least two transfer stations and a logic and control unit for controlling said current supplied by said programmable current supply, said programmable power supply and logic and control unit including a control for transfer station current, having a predetermined time variation, wherein during a time period between a time before said leading edge enters said nip and a time after said trailing edge leaves said nip, said transfer station current is switchably altered by said programmable power supply between at least two predetermined magnitudes of transfer station current included in a plurality of predetermined magnitudes of transfer station current, a predetermined magnitude of transfer station current included in said plurality of predetermined magnitudes of transfer station current is caused to flow in response to a respective control voltage, and said respective control voltage is included in a corresponding plurality of control voltages successively produced by said logic and control unit during passage of said received sheet through said nip, and at least one of said plurality of predetermined magnitudes of transfer station current being low to provide effective wrap suppression of said receiver sheet on said transfer member, and at least one of said plurality of predetermined magnitudes of transfer station current causes said electrostatic transferring of said toner image from said toner image carrier to said toner-image area on said receiver sheet, passage of said receiver sheet through each of said nips is preceded by a leading edge interframe time interval and followed by a trailing edge interframe time interval, and when said transport web moves said receiver sheet successively through said at least two transfer stations, said receiver sheet is electrostatically adhered to said transport web prior to said receiver sheet passing through said at least two transfer stations, and wherein a respective interframe time interval corresponds to a respective interframe distance, said respective interframe distance equal to the product of said respective interframe time interval and said process speed.

2. The electrostatographic machine according to claim 1, wherein a respective area of said receiver sheet less than the full area of said receiver sheet, is associated with application of said respective control voltage.

3. The electrostatographic machine according to claim 1, said receiver sheet following an immediately previous receiver sheet through said nip after said leading edge interframe time interval, wherein:

a first predetermined transfer station current is proportional to a first control voltage and a second predetermined transfer station current is proportional to a second control voltage;

said first control voltage is applied at a first time, said first time occurring before said leading edge enters said nip and when a portion of said leading edge interframe time interval has elapsed, said first control voltage being maintained until a second time, said second time occurring at a time when said toner image carrier is in contact with said leading edge margin area;

said first control voltage is switched by said logic and control unit to said second control voltage at substantially said second time, said second control voltage being maintained until a time after said trailing edge has passed through said nip and further maintained until a portion of said trailing edge interframe time interval has elapsed, whereupon said second control voltage is switched by said logic and control unit to said first control voltage at a third time;

said first predetermined transfer station current has a smaller magnitude than said second predetermined transfer station current;

said first predetermined transfer station current has the same sign as said second predetermined transfer station current; and said portion of said trailing edge interframe time interval corresponds to a predetermined distance along said transport web.

4. The electrostatographic machine according to claim 3, wherein said second time occurs after said leading edge has passed entirely through said nip.

5. The electrostatographic machine according to claim 3, wherein said second time occurs when said leading edge has moved at least 3 millimeters away from said exit from said nip.

6. The electrostatographic machine according to claim 3, wherein said first predetermined transfer station current has a magnitude of substantially zero.

7. The electrostatographic machine according to claim 3, wherein:

said nip has a length measured as Y meters;

said transport web is moved at a process speed measured as S (meters)($sec^{-1}$); and a quantity equal to said second predetermined transfer station current divided by YS is less than or equal to approximately 370 ($\mu$a)(sec)($m^{-2}$).

8. The electrostatographic machine according to claim 7, wherein said quantity equal to said second predetermined transfer station current divided by YS is in a range of approximately between 185 ($\mu$a)(sec)($m^{-2}$) and 325 ($\mu$a)(sec)($m^{-2}$).

9. The electrostatographic machine according to claim 1, wherein, with a receiver sheet following an immediately previous receiver sheet through said nip after said leading edge interframe time interval, a first predetermined transfer station current is proportional to a first control voltage, a second predetermined transfer station current is proportional to a second control voltage, a third predetermined transfer station current is proportional to a third control voltage, and a fourth predetermined transfer station current is proportional to a fourth control voltage;

said first control voltage is applied at a first time, said first time occurring before said leading edge enters said nip and when a portion of said leading edge interframe time interval has elapsed, with said first control voltage being maintained until a second time, said second time occurring at a time when said toner image carrier is in contact with said leading edge margin area;

said first control voltage is switched by said logic and control unit to said second control voltage at substantially said second time, said second control voltage being maintained until a third time, said third time occurring at a time when said toner image carrier remains in contact with said leading edge margin area but is not in contact with said toner-image area;

said second control voltage is switched by said logic and control unit to said third control voltage at substantially said third time, said third control voltage being maintained until a forth time after said trailing edge has moved past said exit from said nip, said fourth time occurring when a first portion of said trailing edge interframe time interval has elapsed;

said third control voltage is switched by said logic and control unit to said fourth control voltage at substantially said forth time, said fourth control voltage being maintained until a fifth time, said fifth time occurring when said first portion and a second portion of said trailing edge interframe time interval have elapsed;

at substantially said fifth time said fourth control voltage is switched by said logic and control unit to said first control voltage;

said second predetermined transfer station current has the same sign as said third predetermined transfer station current;

a magnitude of said second predetermined transfer station current is greater than or equal to a magnitude of said third predetermined transfer station current;

said fourth predetermined transfer station current has a sign opposite to the sign of said third predetermined transfer station current; and a sum of said first portion and said second portion of said trailing edge interframe time interval corresponds to a predetermined distance along said transport web.

10. The electrostatographic machine according to claim 9, wherein said first predetermined transfer station current has a magnitude of substantially zero.

11. The electrostatographic machine according to claim 10, wherein:

said nip has a length measured as Y meters;

said transport web is moved at a process speed measured as S (meters)($sec^{-1}$); and a quantity equal to said third predetermined transfer station current divided by YS is less than or equal to approximately 370 ($\mu$a)(sec)($m^{-2}$).

12. The electrostatographic machine according to claim 11, wherein said quantity equal to said third predetermined transfer station current divided by YS is in a range of approximately between 185 ($\mu$a)(sec)($m^{-2}$) and 325 ($\mu$a)(sec)($m^{-2}$).

13. The electrostatographic machine according to claim 10, wherein:

said third predetermined transfer station current produces a transfer voltage between said toner image carrier and said transfer member, said transfer voltage associated with a transfer capacitance;

for a condition of switching said transfer station current from said first transfer station current to said second transfer station current, with said magnitude of said second transfer station current greater than said magnitude of said third transfer station current, said transfer voltage substantially reaches a preferred magnitude when after a time interval approximately equal to said third time minus said second time, said transfer capacitance is effectively charged by said second transfer station current;

for another condition of switching said transfer station current from said first transfer station current to said second transfer station current, with said magnitude of said second transfer station current equal to said magnitude of said third transfer station current, said transfer voltage substantially reaches said preferred magnitude when said transfer capacitance is effectively charged by said third transfer station current after a corresponding time interval said corresponding time interval independently measurable; and wherein, for said condition with said magnitude of said second transfer station current greater than said magnitude of said third transfer station current, the following approximate equality obtains: said second transfer station current multiplied by the difference between said third time and said second time is substantially equal to said third transfer station current multiplied by said corresponding time interval.

14. The electrostatographic machine according to claim 9, wherein said second time occurs after said leading edge has passed entirely through said nip.

15. The electrostatographic machine according to claim 9, wherein said second time occurs when said leading edge has moved at least 3 millimeters away from said exit from said nip.

16. The electrostatographic machine according to claim 1, said receiver sheet following an immediately previous receiver sheet through said nip after a certain interframe time interval, wherein;

a first predetermined transfer station current is proportional to a first control voltage and a second predetermined transfer station current is proportional to a second control voltage;

said first control voltage is applied at a first time, said first time occurring before said leading edge enters said nip, said first control voltage being maintained until a second time, said second time occurring at a time when said toner image carrier is in contact with said leading edge margin area;

said first control voltage is switched by said logic and control unit to said second control voltage at substantially said second time, said second control voltage being maintained until a third time occurring at a time when said toner image carrier is in contact with said trailing edge margin area;

said first predetermined transfer station current has a smaller magnitude than said second predetermined transfer station current;

said first predetermined transfer station current has the same sign as said second predetermined transfer station current; and said second control voltage is switched to said first control voltage at substantially said third time and further maintained until a time when said trailing edge has moved past said exit from said nip.

17. The electrostatographic machine according to claim 16, wherein said second time occurs after said leading edge has passed entirely through said nip.

18. The electrostatographic machine according to claim 16, wherein said second time occurs when said leading edge has moved at least 3 millimeters away from said exit from said nip.

19. The electrostatographic machine according to claim 16, wherein said first predetermined transfer station current has a magnitude of substantially zero.

20. The electrostatographic machine according to claim 19, wherein:

said nip has a length measured as Y meters;

said transport web is moved at a process speed measured as S (meters)($sec^{-1}$); and a quantity equal to said second predetermined transfer station current divided by YS is less than or equal to approximately 370 ($\mu$a)(sec)($m^{-2}$).

21. The electrostatographic machine according to claim 20, wherein said quantity equal to said second predetermined transfer station current divided by YS is in a range of approximately between 185 ($\mu$a)(sec)($m^{-2}$) and 325 ($\mu$a)(sec)($m^{-2}$).

22. The electrostatographic machine according to claim 1, said receiver sheet following an immediately previous receiver sheet through said nip after said leading edge interframe time interval, wherein:

a first predetermined transfer station current is proportional to a first control voltage, a second predetermined transfer station current is proportional to a second control voltage, a third predetermined transfer station current is proportional to a third control voltage, and a fourth predetermined transfer station current is proportional to a fourth control voltage;

said first control voltage is applied at a first time, said first time occurring before said leading edge enters said nip and when a portion of said leading edge interframe time interval has elapsed, with said first control voltage being maintained until a second time, said second time occurring at a time when said toner image carrier is in contact with said leading edge margin area;

said first control voltage is switched by said logic and control unit to said second control voltage at substantially said second time, said second control voltage being maintained until a third time, said third time occurring at a time when said toner image carrier remains in contact with said leading edge margin area but is not in contact with said toner-image area;

said second control voltage is switched by said logic and control unit to said third control voltage at substantially said third time, said third control voltage being maintained until a fourth time, said fourth time occurring at a time when said toner image carrier is in contact with said trailing edge margin area;

said third control voltage is switched by said logic and control unit to said fourth control voltage at substantially said fourth time, said fourth control voltage being maintained until a fifth time, said fifth time occurring at a time when said toner image carrier remains in contact with said leading edge margin area but is not in contact with said toner-image area;

at substantially said fifth time said fourth control voltage is switched by said logic and control unit to said first control voltage;

said second predetermined transfer station current has the same sign as said third predetermined transfer station current;

the magnitude of said second predetermined transfer station current is greater than or equal to the magnitude of said third predetermined transfer station current; and said fourth predetermined transfer station current has a sign opposite to the sign of said third predetermined transfer station current.

23. The electrostatographic machine according to claim 22, wherein said first predetermined transfer station current has a magnitude of substantially zero.

24. The electrostatographic machine according to claim 23, wherein:

said nip has a length measured as Y meters;

said transport web is moved at a process speed measured as S (meters)($sec^{-1}$); and a quantity equal to said third predetermined transfer station current divided by YS is less than or equal to approximately 370 ($\mu$a)(sec)($m^{-2}$).

25. The electrostatographic machine according to claim 24, wherein said quantity equal to said third predetermined transfer station current divided by YS is in a range of approximately between 185 ($\mu$a)(sec)($m^{-2}$) and 325 ($\mu$a)(sec)($m^{-2}$).

26. The electrostatographic machine according to claim 22, wherein:

said first predetermined transfer station current has a magnitude of substantially zero;

said third predetermined transfer station current produces a transfer voltage between said toner image carrier and said transfer member, said transfer voltage associated with a transfer capacitance;

for a condition of switching said transfer station current from said first predetermined transfer station current to said second predetermined transfer station current, with said magnitude of said second predetermined transfer station current greater than said magnitude of said third predetermined transfer station current, said transfer voltage substantially reaches a preferred magnitude when after a time interval approximately equal to said third time minus said second time said transfer capacitance is effectively charged by said second predetermined transfer station current;

for another condition of switching said transfer station current from said first predetermined transfer station current to said second predetermined transfer station current, with said magnitude of said second predetermined transfer station current equal to said magnitude of said third predetermined transfer station current, said transfer voltage substantially reaches said preferred magnitude when said transfer capacitance is effectively charged by said third predetermined transfer station current after a corresponding time interval said corresponding time interval independently measurable; and wherein, for said condition with said magnitude of said second predetermined transfer station current greater than said magnitude of said third predetermined transfer station current, the following approximate equality obtains: said second predetermined transfer station current multiplied by the difference between said third time and said second time is substantially equal to said third predetermined transfer station current multiplied by said corresponding time interval.

27. The electrostatographic machine according to claim 22, wherein said second time occurs after said leading edge has passed entirely through said nip.

28. The electrostatographic machine according to claim 22, wherein said second time occurs when said leading edge has moved at least 3 millimeters away from said exit from said nip.

29. The electrostatographic machine according to claim 1, wherein said toner image carrier is a compliant intermediate transfer roller.

30. The electrostatographic machine according to claim 29, wherein said compliant intermediate transfer roller includes a core member, with an elastically deformable layer on the core member and a thin hard overcoat on said elastically deformable layer.

31. The electrostatographic machine according to claim 1, wherein said transfer member is a compliant roller having an elastically deformable resistive layer.

32. The electrostatographic machine according to claim 1, wherein said nip width is smaller than a width of said leading edge margin area.

33. The electrostatographic machine according to claim 1, wherein said nip width is smaller than a width of said trailing edge margin area.

34. The electrostatographic machine according to claim 1, wherein:

a moving position of said leading edge of said receiver sheet is determined from a time said leading edge passes an edge-detecting sensor, said time said leading edge passes said edge-detecting sensor occurring prior to entry of said receiver sheet into said nip;

said edge-detecting sensor is located at a known distance ahead of said nip;

said time said leading edge passes said edge-detecting sensor is sent as a signal to a logic and control unit;

said moving position of said leading edge of said receiver sheet relative to said nip is computed in said logic and control unit from a value of a predetermined speed of said receiver sheet moving toward said nip and a value of said time said leading edge passes said edge-detecting sensor; and said logic and control unit sends electronic signals to said programmable power supply so as to provide, during said time period between a time before said leading edge enters said nip and a time after said trailing edge leaves said nip, said at least two predetermined magnitudes of transfer station current included in said plurality of predetermined magnitudes of transfer station current.

35. The electrostatographic machine according to claim 1, said electrostatographic machine in a purge mode, wherein said respective transfer station currents in said respective imaging modules has a predetermined low continuous magnitude of substantially zero.

36. The electrostatographic machine according to claim 1, wherein said transfer station current is preferably zero in at least a portion of said leading edge margin area.

37. A method for transferring in a transfer station of an electrostatographic machine a toner image from a toner image carrier to a receiver sheet, said toner image carrier forming a nip with a transfer member, with a transport web movable through said nip, said transport web having a front face and a back face, said back face contacting said transfer member, said receiver sheet movable through said nip with said receiver sheet in contact with said toner image carrier, said receiver sheet having a leading edge and a trailing edge, said nip having an entrance and an exit, said exit separated from said entrance by a nip width, said transfer station for applying an electric field between said toner image carrier and said transfer member, said electric field in said nip for urging toner particles included in said toner image to transfer from said toner image carrier to said receiver sheet, said receiver sheet including margin areas wherein said toner image is not transferred, said margin areas including a leading edge margin area and a trailing edge margin area, said nip width smaller than a width of said leading edge margin area and also smaller than a width of said trailing edge margin area, said transfer station including a programmable power supply for supplying a predetermined transfer station current, said predetermined transfer station current included in a plurality of predetermined transfer station currents, said plurality of predetermined transfer station currents flowing between said toner image carrier and said transfer member, said method including the steps of:

electrostatically adhering said receiver sheet to said front face of said transport web;

activating said programmable power supply so as to produce a first predetermined transfer station current of a substantially low magnitude to provide effective wrap suppression;

while maintaining said first predetermined transfer station current, transporting said receiver sheet on said transport web until a time when said leading edge has moved through said nip and past said exit from said nip and said nip width contained within said leading edge margin area;

while continuing to transport said receiver sheet on said transport web and with said nip width contained within said leading edge margin area, activating said programmable power supply to switch said first predetermined transfer station current to a second predetermined transfer station current, said second predetermined transfer station current having a magnitude greater than a magnitude of said first predetermined transfer station current, said second predetermined transfer station current having the same sign as the sign of said first predetermined transfer station current;

while continuing to transport said receiver sheet on said transport web and with said nip width yet contained within said leading edge margin area, activating said programmable power supply to switch said second predetermined transfer station current to a third predetermined transfer station current, said third predetermined transfer station current having a magnitude greater than said magnitude of said first predetermined transfer station current, said third predetermined transfer station current having a magnitude smaller than said magnitude of said second predetermined transfer station current, said third predetermined transfer station current having the same sign as said sign of said second predetermined transfer station current;

while maintaining said third predetermined transfer station current, transporting said receiver sheet on said transport web until a predetermined time when said trailing edge has moved through said nip to a predetermined distance past said exit from said nip;

at said predetermined time when said trailing edge has moved through said nip to a predetermined distance past said exit from said nip and while continuing to transport said receiver sheet on said transport web, activating said programmable power supply to switch said third predetermined transfer station current to a fourth predetermined transfer station current, said fourth predetermined transfer station current having a sign opposite to said sign of said third predetermined transfer station current; and while continuing to transport said receiver sheet on said transport web and after a predetermined time following said activating said programmable power supply to switch said third predetermined transfer station current to said fourth predetermined transfer station current, activating said programmable power supply to switch said fourth predetermined transfer station current to said first predetermined transfer station current.

38. The method of claim 37, wherein said first predetermined transfer station current has a magnitude of substantially zero.

39. A method for transferring in a transfer station of an electrostatographic machine a toner image from a toner image carrier to a receiver sheet, said toner image carrier forming a nip with a transfer member, with a transport web movable through said nip, said transport web having a front face and a back face, said back face contacting said transfer member, said receiver sheet movable through said nip with said receiver sheet in contact with said toner image carrier, said receiver sheet having a leading edge and a trailing edge, said nip having an entrance and an exit, said exit separated from said entrance by a nip width, said transfer station for applying an electric field between said toner image carrier and said transfer member, said electric field in said nip for urging toner particles included in said toner image to transfer from said toner image carrier to said receiver sheet, said receiver sheet including margin areas wherein said toner image is not transferred, said margin areas including a leading edge margin area and a trailing edge margin area, said nip width smaller than a width of said leading edge margin area and also smaller than a width of said trailing edge margin area, said transfer station including a programmable power supply for supplying a predetermined transfer station current, said predetermined transfer station current included in a plurality of predetermined transfer station currents, said plurality of predetermined transfer station currents flowing between said toner image carrier and said transfer member, said method including the steps of:

electrostatically adhering said receiver sheet to said front face of said transport web;

activating said programmable power supply so as to produce a first predetermined transfer station current;

while maintaining said first predetermined transfer station current, transporting said receiver sheet on said transport web until a time when said leading edge has moved through said nip and past said exit from said nip and said nip width yet contained within said leading edge margin area;

while continuing to transport said receiver sheet on said transport web and with said nip width contained within said leading edge margin area, activating said programmable power supply to switch said first predetermined transfer station current to a second predetermined transfer station current, said second predetermined transfer station current having a magnitude greater than a magnitude of said first predetermined transfer station current, said second predetermined transfer station current having the same sign as the sign of said first predetermined transfer station current;

while continuing to transport said receiver sheet on said transport web and with said nip width contained within said leading edge margin area, activating said programmable power supply to switch said second predetermined transfer station current to a third predetermined transfer station current, said third predetermined transfer station current having a magnitude greater than said magnitude of said first predetermined transfer station current, said third predetermined transfer station current having a magnitude smaller than said magnitude of said second predetermined transfer station current, said third predetermined transfer station current having the same sign as said sign of said second predetermined transfer station current;

while maintaining said third predetermined transfer station current, transporting said receiver sheet on said transport web until a time when said nip width is contained within said trailing edge margin area;

while continuing to transport said receiver sheet on said transport web and said nip width yet contained within said trailing edge margin area, activating said programmable power supply to switch said third predetermined transfer station current to a fourth predetermined transfer station current, said fourth predetermined transfer station current having a sign opposite to said sign of said third predetermined transfer station current;

while continuing to transport said receiver sheet on said transport web and after a maintaining said fourth predetermined transfer station current for a predetermined time, activating said programmable power supply to switch said fourth predetermined transfer station current to said first predetermined transfer station current.

40. The method of claim 39, wherein said first predetermined transfer station current has a magnitude of substantially zero.

* * * * *